US011787171B2

(12) United States Patent
Kim et al.

(10) Patent No.: US 11,787,171 B2
(45) Date of Patent: Oct. 17, 2023

(54) APPARATUS FOR CORRECTING IMPACT POINT OF INK AND SYSTEM FOR TREATING SUBSTRATE WITH THE APPARATUS

(71) Applicant: SEMES CO., LTD., Chungcheongnam-do (KR)

(72) Inventors: Sung Ho Kim, Chungcheongnam-do (KR); Yoon Ok Jang, Chungcheongnam-do (KR); Hyun Min Lee, Gyeongsangnam-do (KR); Jun Seok Lee, Chungcheongnam-do (KR); Kwang Jun Choi, Daejeon (KR)

(73) Assignee: Semes Co., Ltd., Chungcheongnam-do (KR)

( * ) Notice: Subject to any disclaimer, the term of this patent is extended or adjusted under 35 U.S.C. 154(b) by 57 days.

(21) Appl. No.: 17/337,967

(22) Filed: Jun. 3, 2021

(65) Prior Publication Data

US 2022/0009224 A1 Jan. 13, 2022

(30) Foreign Application Priority Data

Jul. 7, 2020 (KR) ..... 10-2020-0083245

(51) Int. Cl.
*B41J 2/045* (2006.01)
*B41J 3/407* (2006.01)

(52) U.S. Cl.
CPC ..... *B41J 2/04505* (2013.01); *B41J 2/04508* (2013.01); *B41J 2/04551* (2013.01); *B41J 2/04558* (2013.01); *B41J 3/407* (2013.01)

(58) Field of Classification Search
CPC ..... B41J 2202/09
See application file for complete search history.

(56) References Cited

U.S. PATENT DOCUMENTS

2005/0177343 A1* 8/2005 Nagae ..... H04R 9/06 702/183
2007/0070107 A1* 3/2007 Shamoun ..... B41J 29/393 347/14

(Continued)

FOREIGN PATENT DOCUMENTS

JP 05238004 A 9/1993
JP 08139949 A 5/1996
JP 2003276170 A 9/2003

OTHER PUBLICATIONS

Korean Request for the Submission of an Opinion for Korean Application No. 10-2020-0083245, dated Feb. 17, 2023 with translation, 17 pages.

(Continued)

*Primary Examiner* — Shelby L Fidler
(74) *Attorney, Agent, or Firm* — RatnerPrestia

(57) ABSTRACT

An ink impact point correction apparatus for automatically measuring and correcting an impact point of ink using a pattern on a substrate, on which a coordinate system is displayed, and a substrate treating system including the same are provided. The ink impact point correction apparatus includes a recognition unit for acquiring information on the impact point of ink at a plurality of points located on a substrate; and a correction unit for correcting a position of an ink discharge point on the substrate based on the information on the impact point, wherein a coordinate pattern in the form of a coordinate system is formed at the plurality of points.

17 Claims, 24 Drawing Sheets

(56) References Cited

U.S. PATENT DOCUMENTS

| | | | | |
|---|---|---|---|---|
| 2010/0309241 | A1* | 12/2010 | Kwon | B41J 29/393 347/14 |
| 2013/0177343 | A1* | 7/2013 | Lass, Jr. | B41J 29/393 356/73 |
| 2015/0259784 | A1* | 9/2015 | Goto | B41J 2/04581 427/8 |
| 2018/0261472 | A1* | 9/2018 | Miyazaki | B41J 29/393 |

OTHER PUBLICATIONS

Korean Written Decision on Registration for Korean Application No. 10-2020-0083245, dated Jun. 9, 2023 with translation, 5 pages.

* cited by examiner

[FIG. 1]
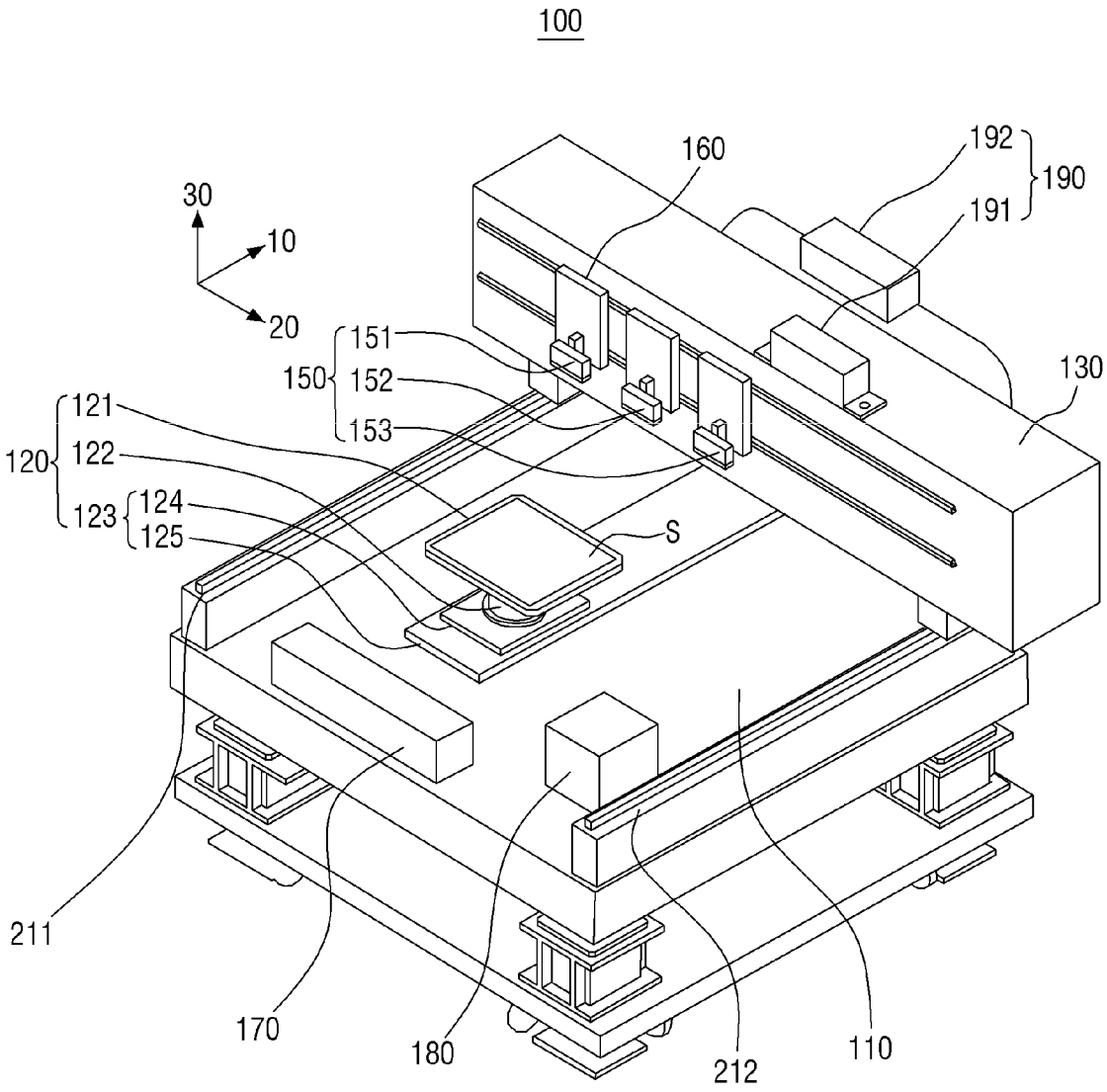

[FIG. 2]
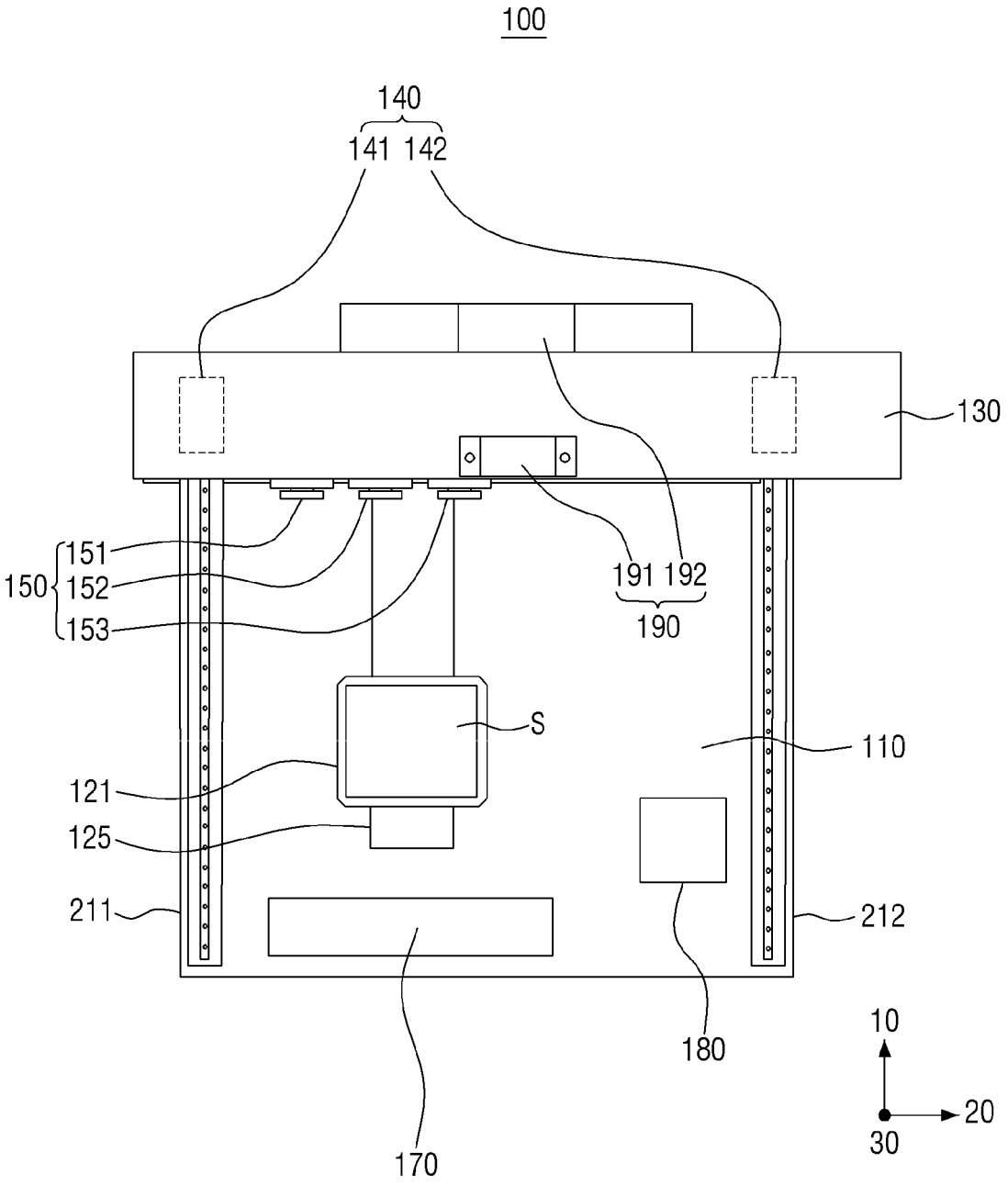

[FIG. 3]
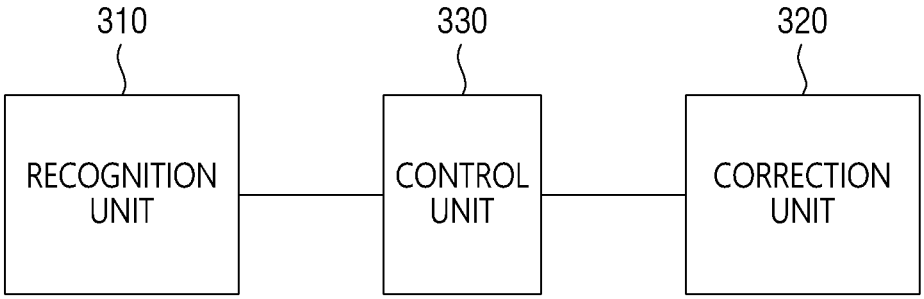

[FIG. 4]
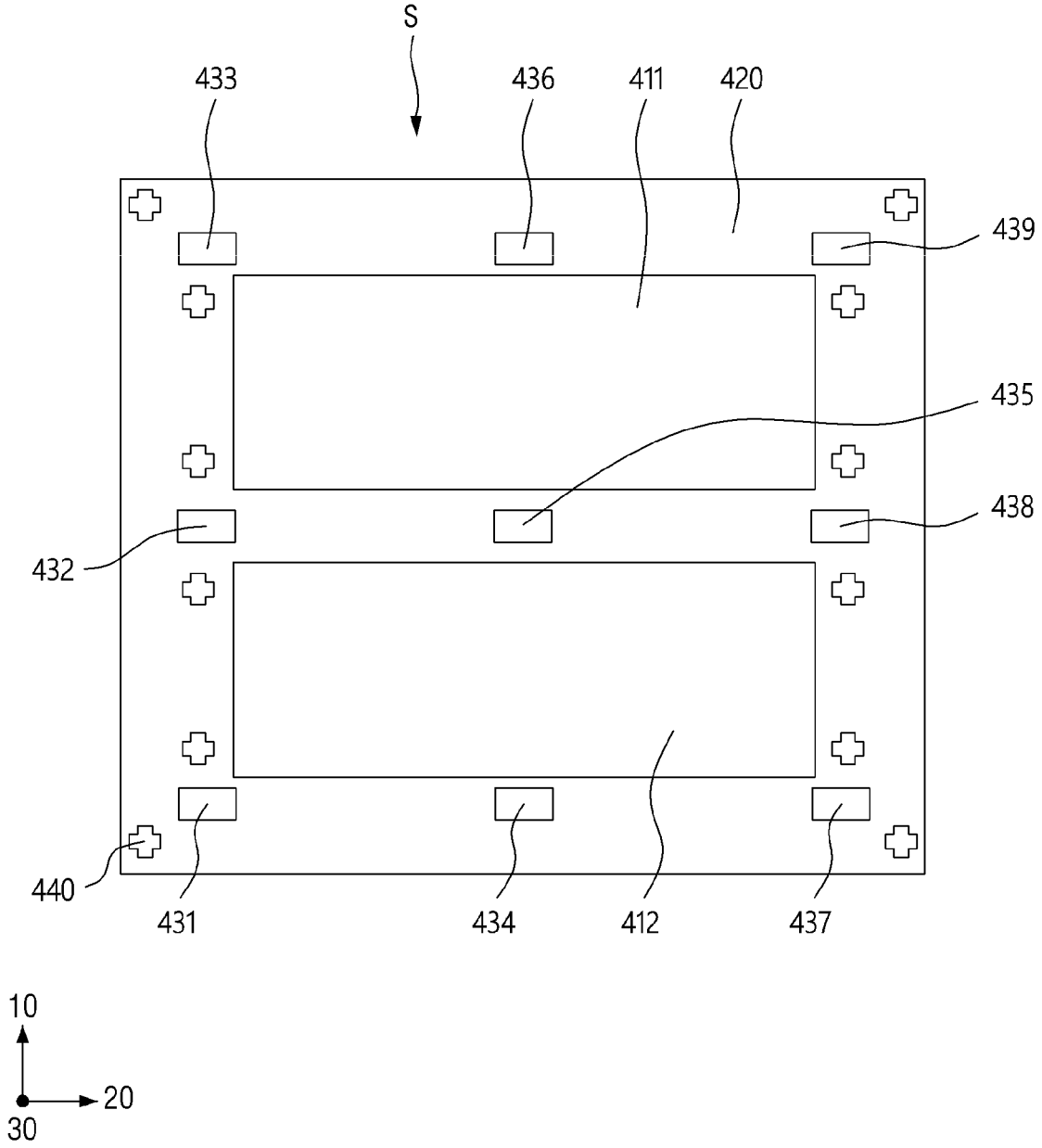

[FIG. 5]
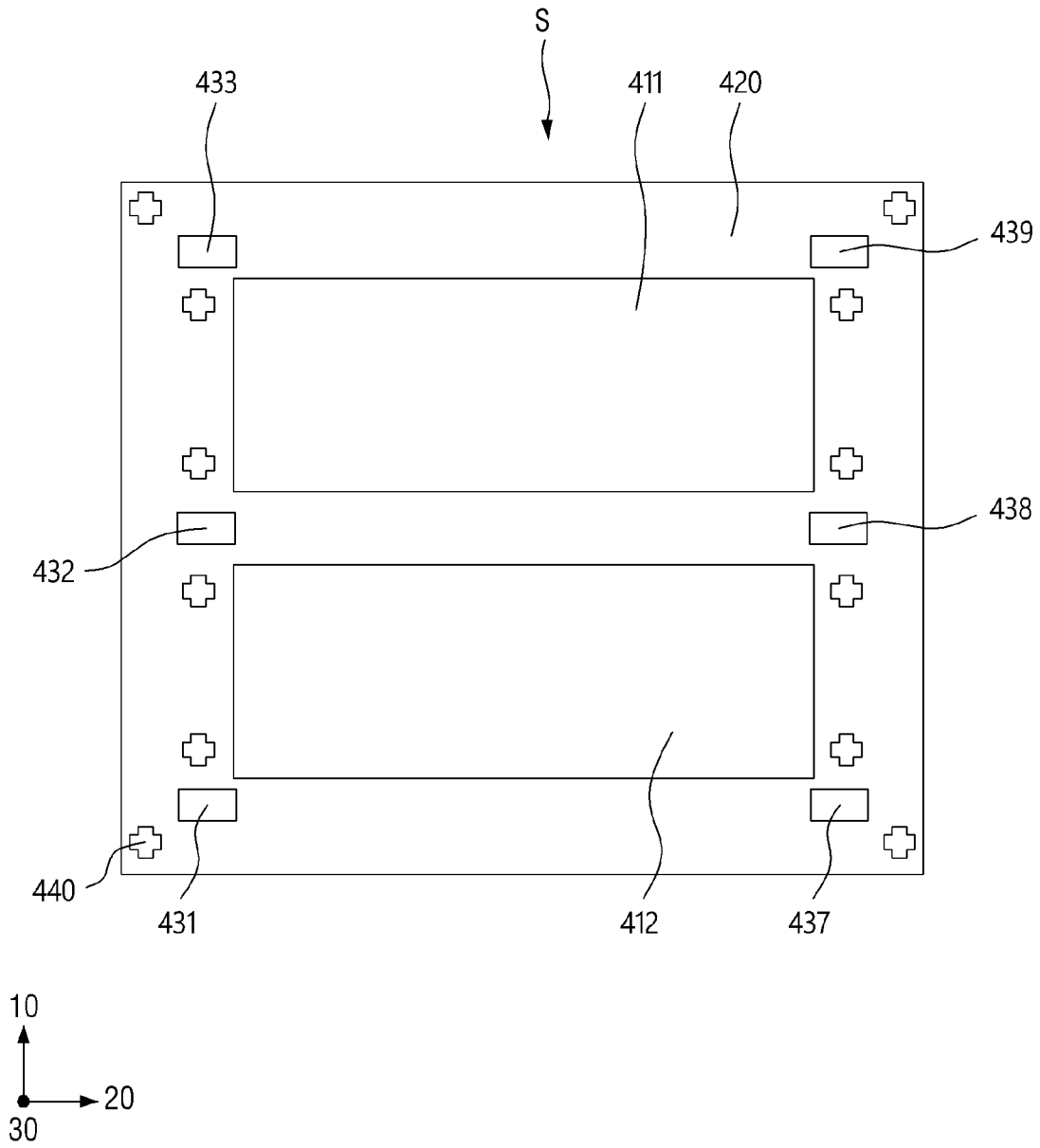

[FIG. 6]
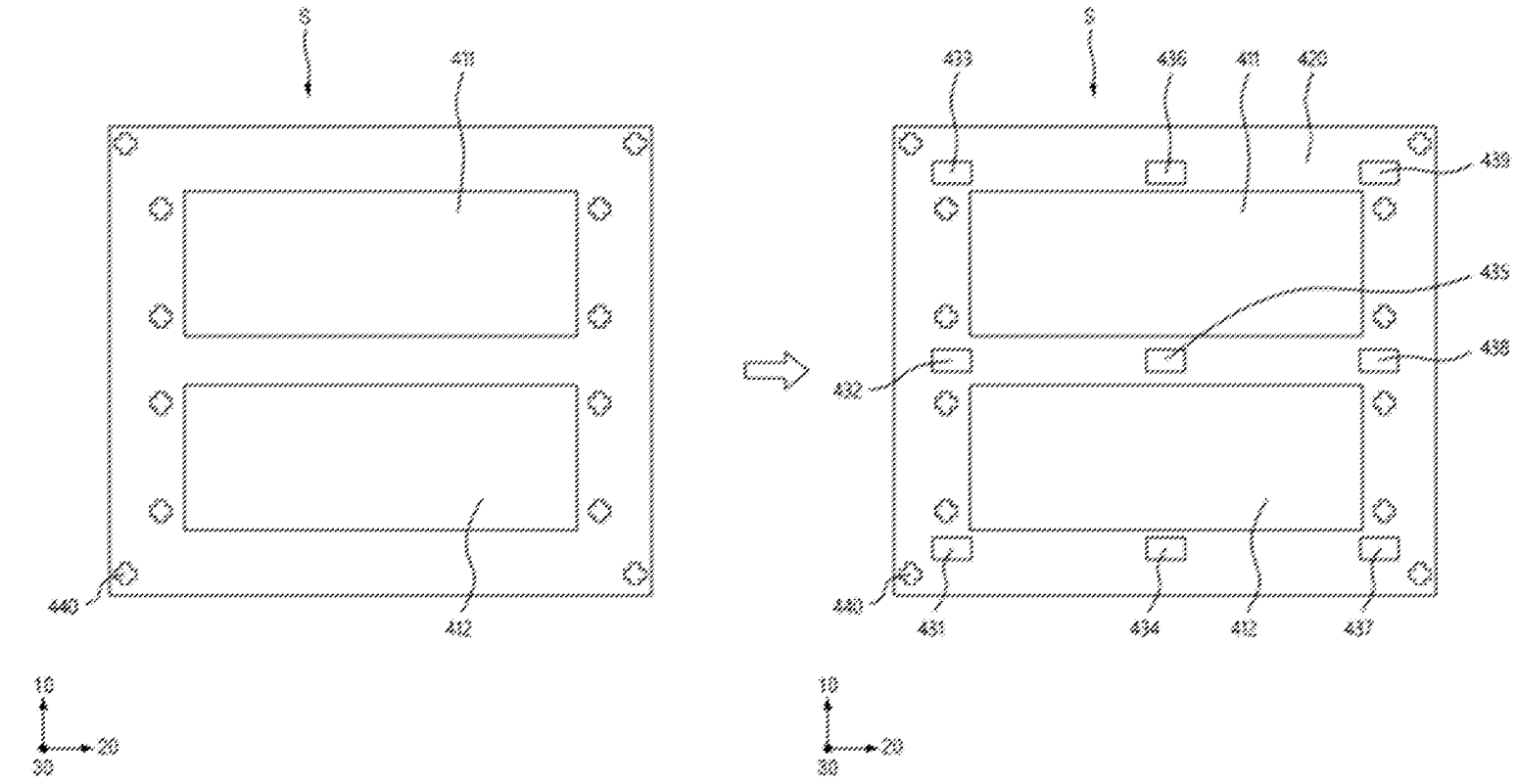

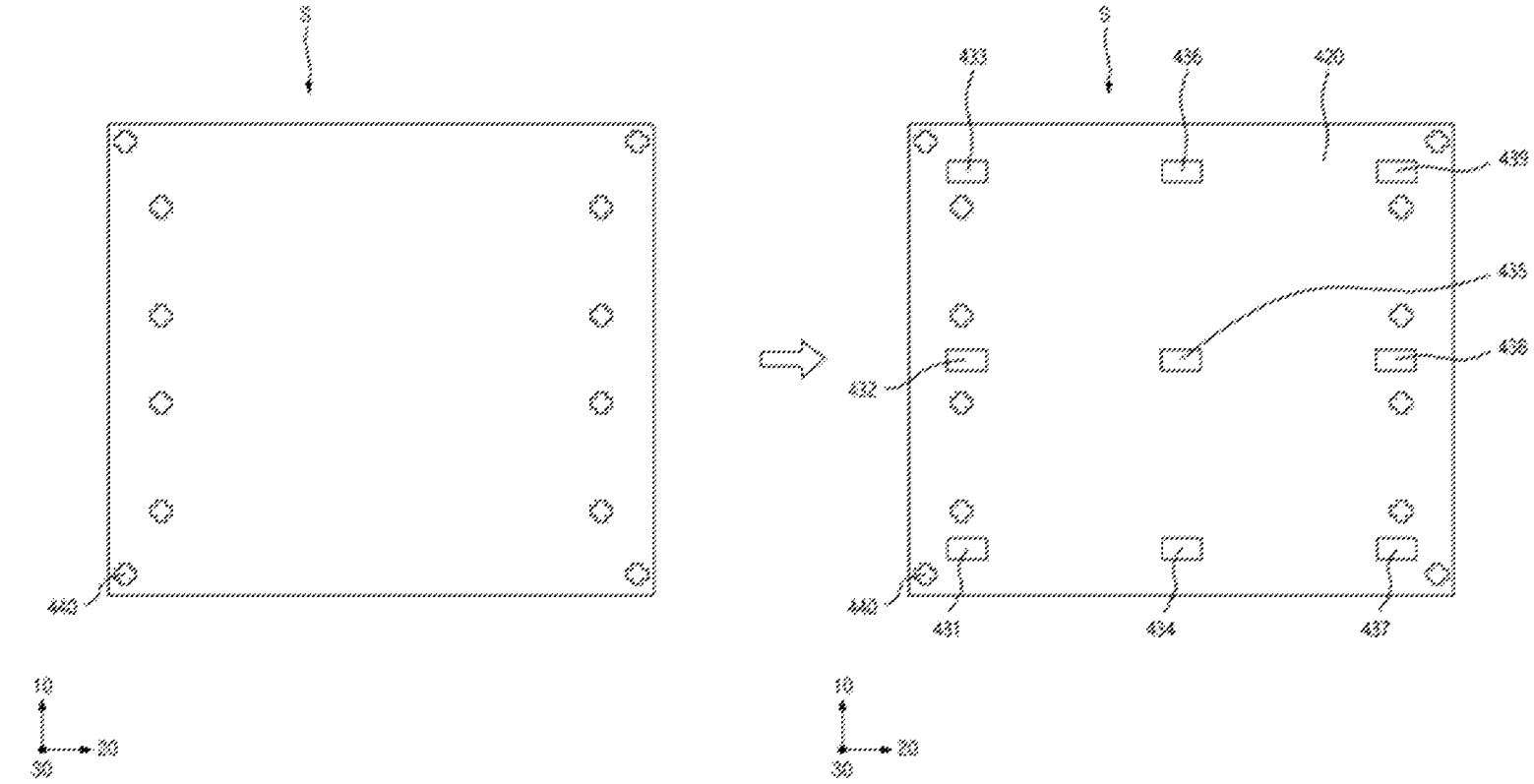
[FIG. 7]

[FIG. 8]
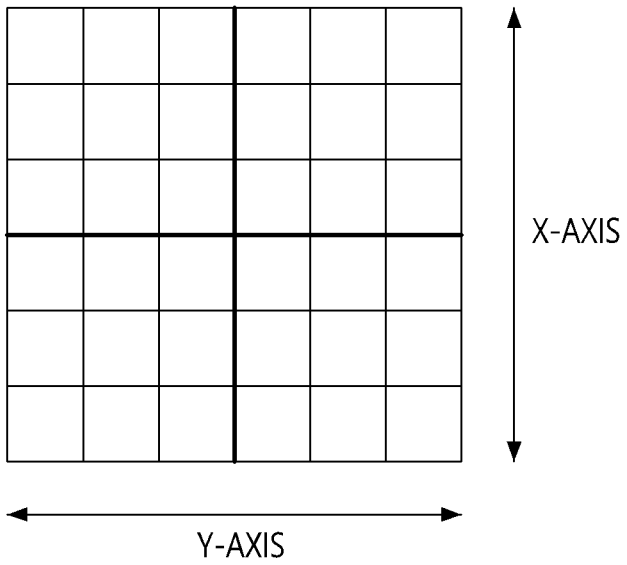

[FIG. 9]
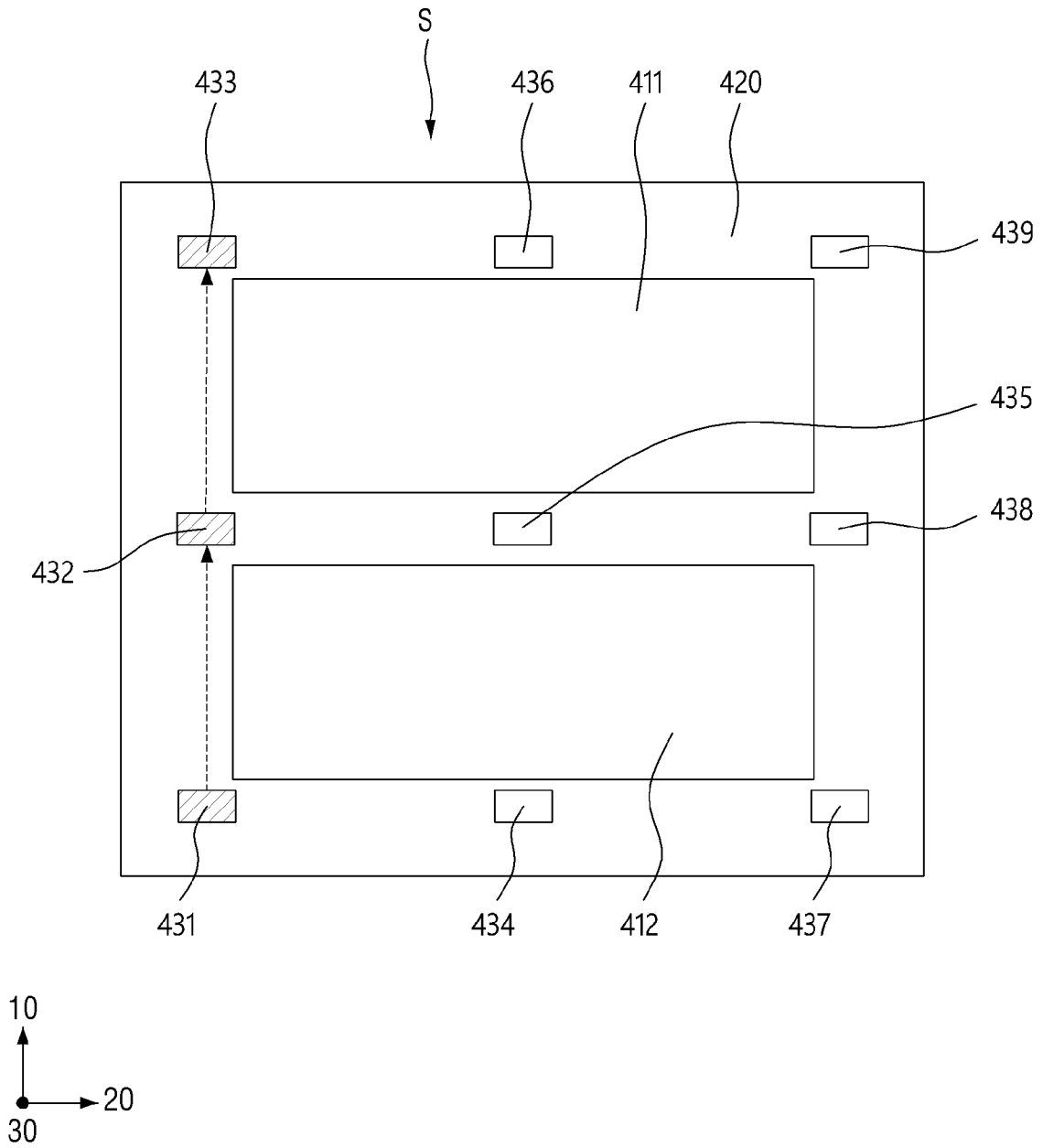

[FIG. 10]
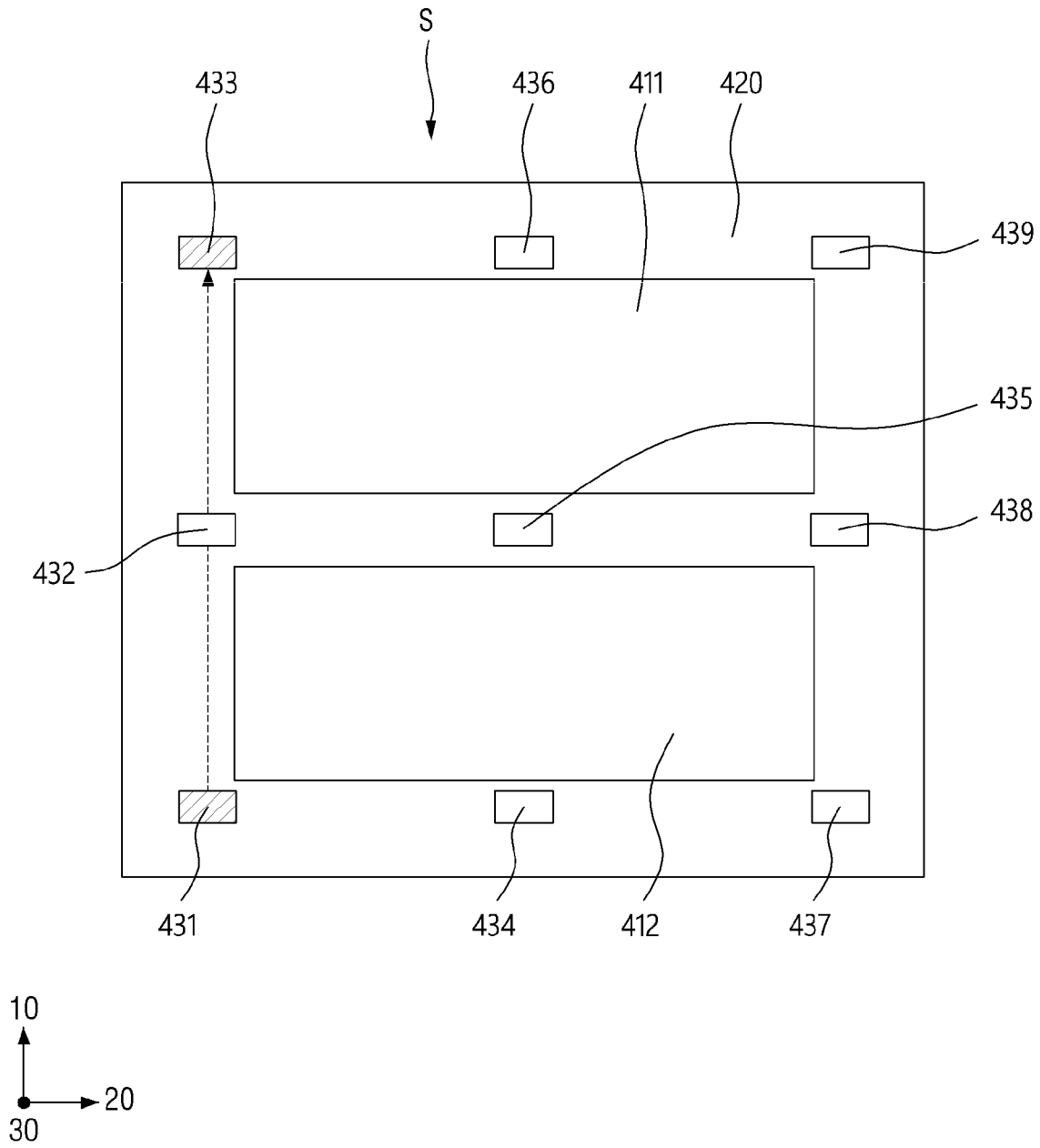

[FIG. 11]
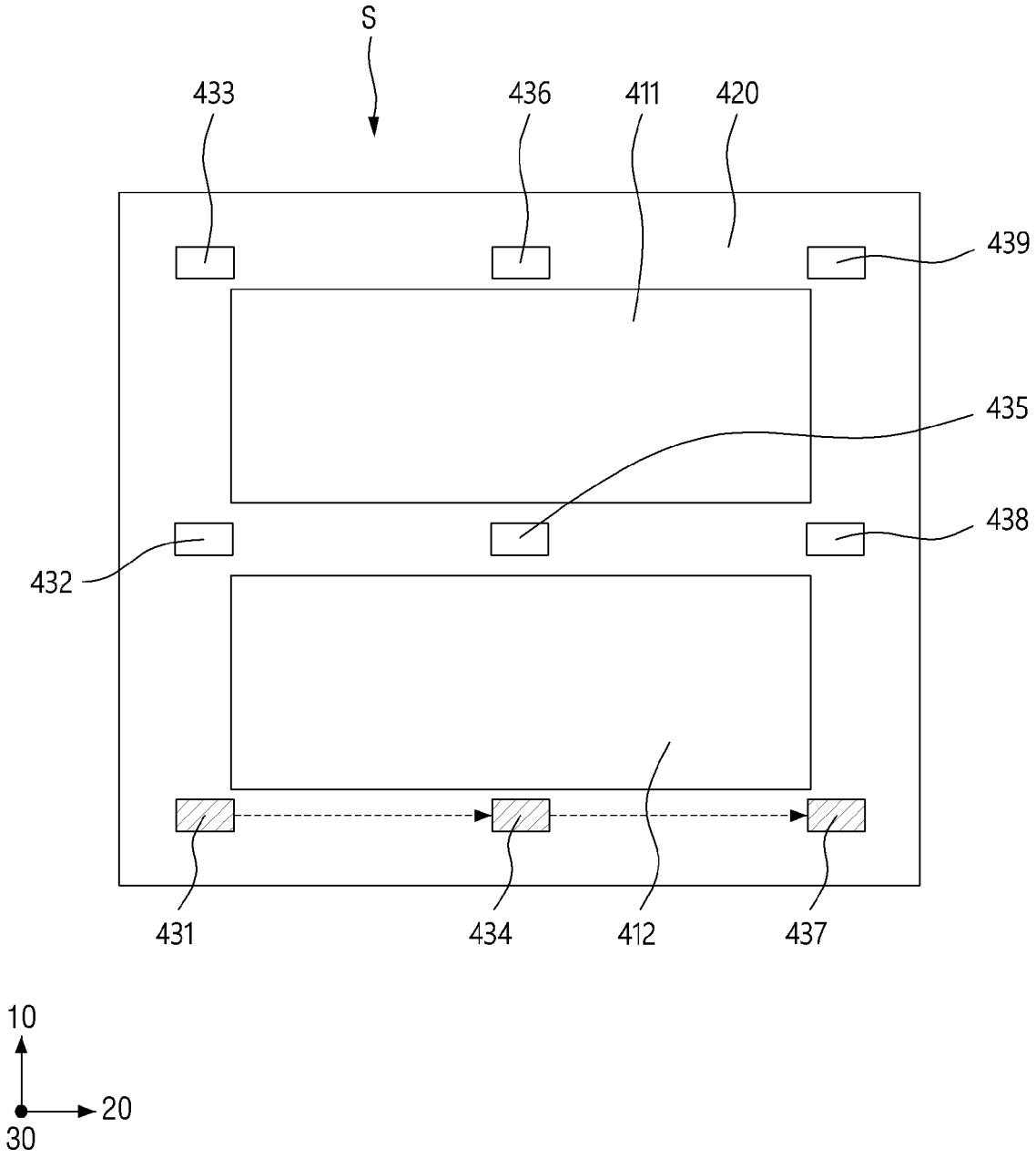

[FIG. 12]
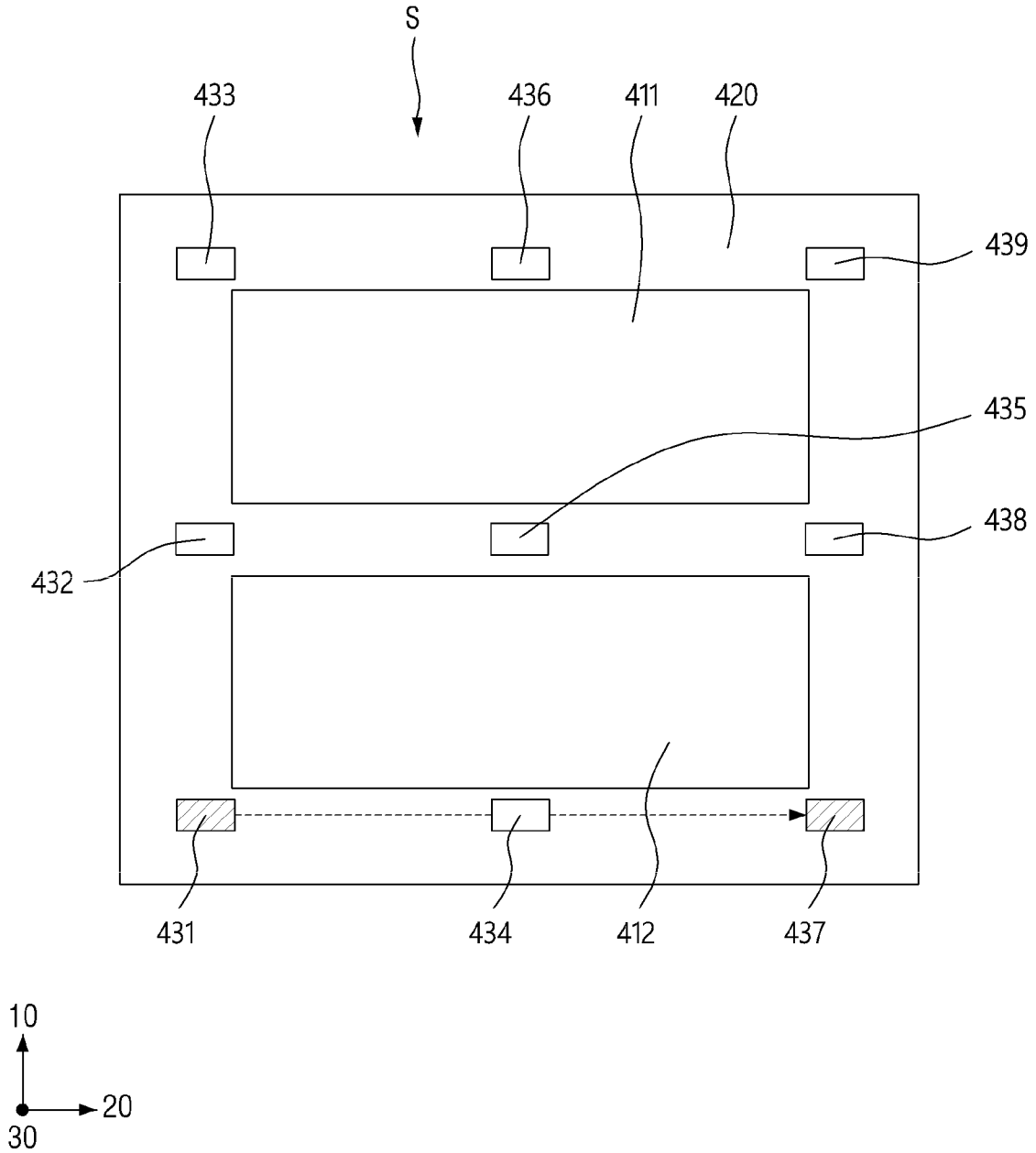

[FIG. 13]
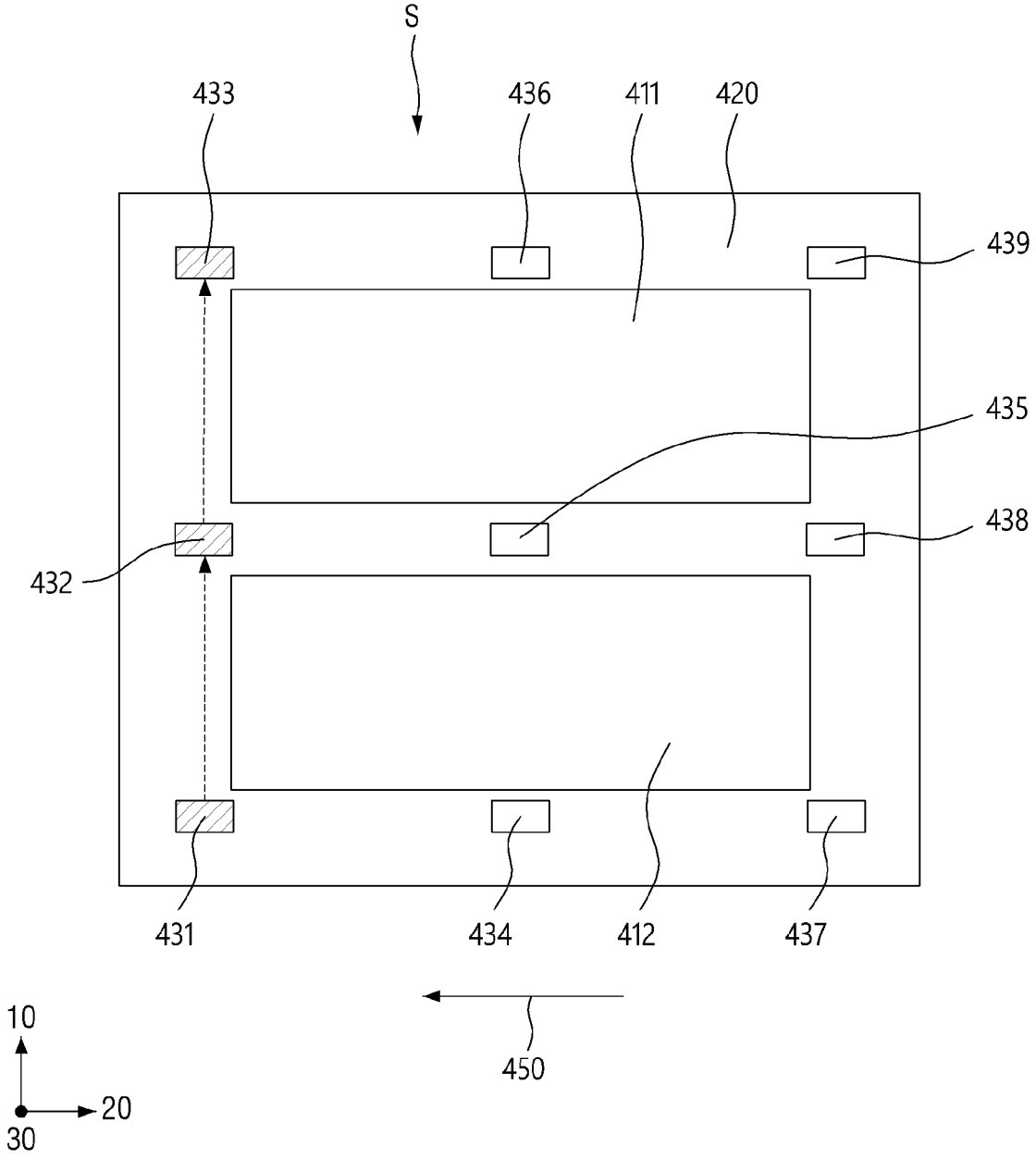

[FIG. 14]
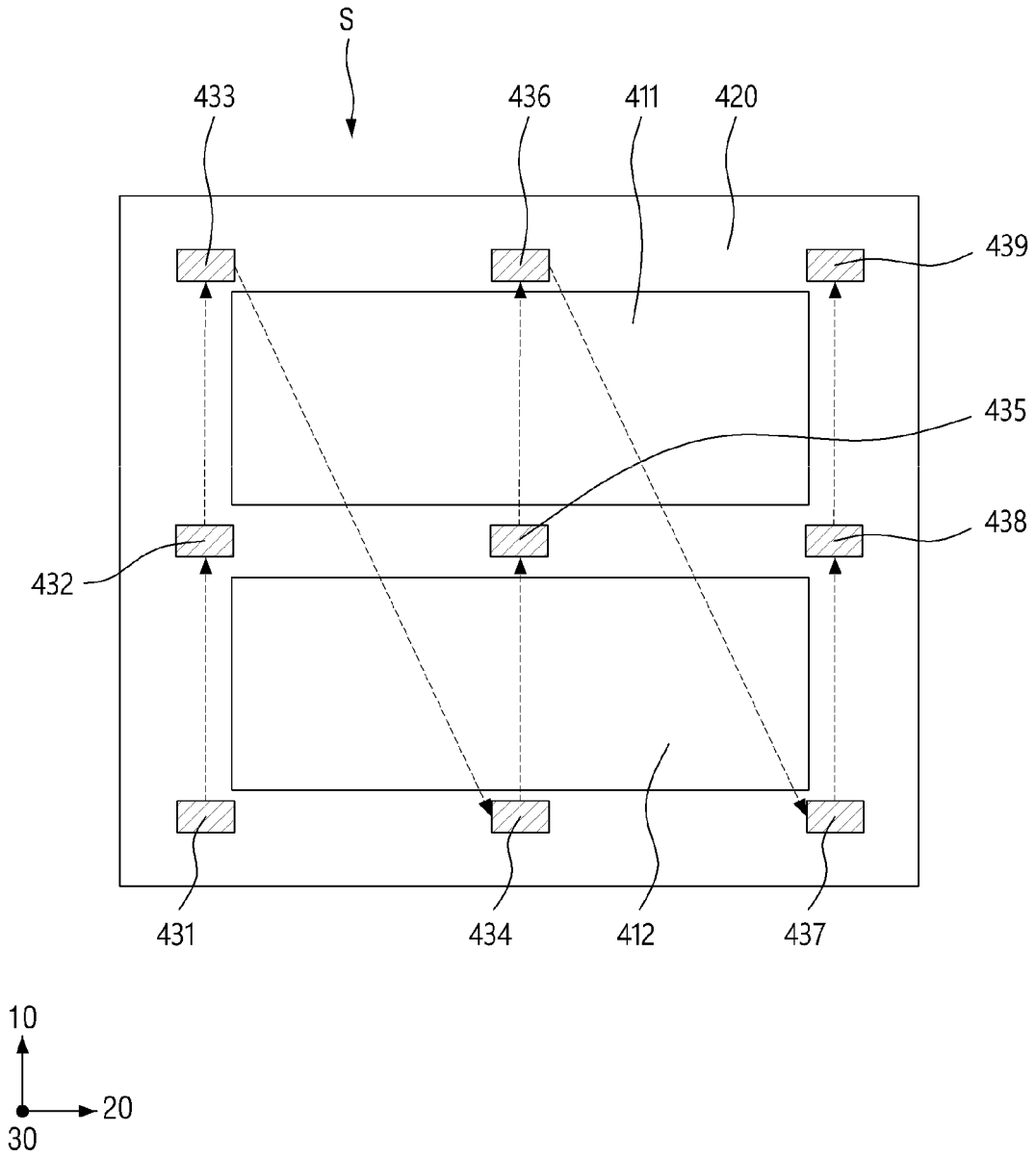

[FIG. 15]
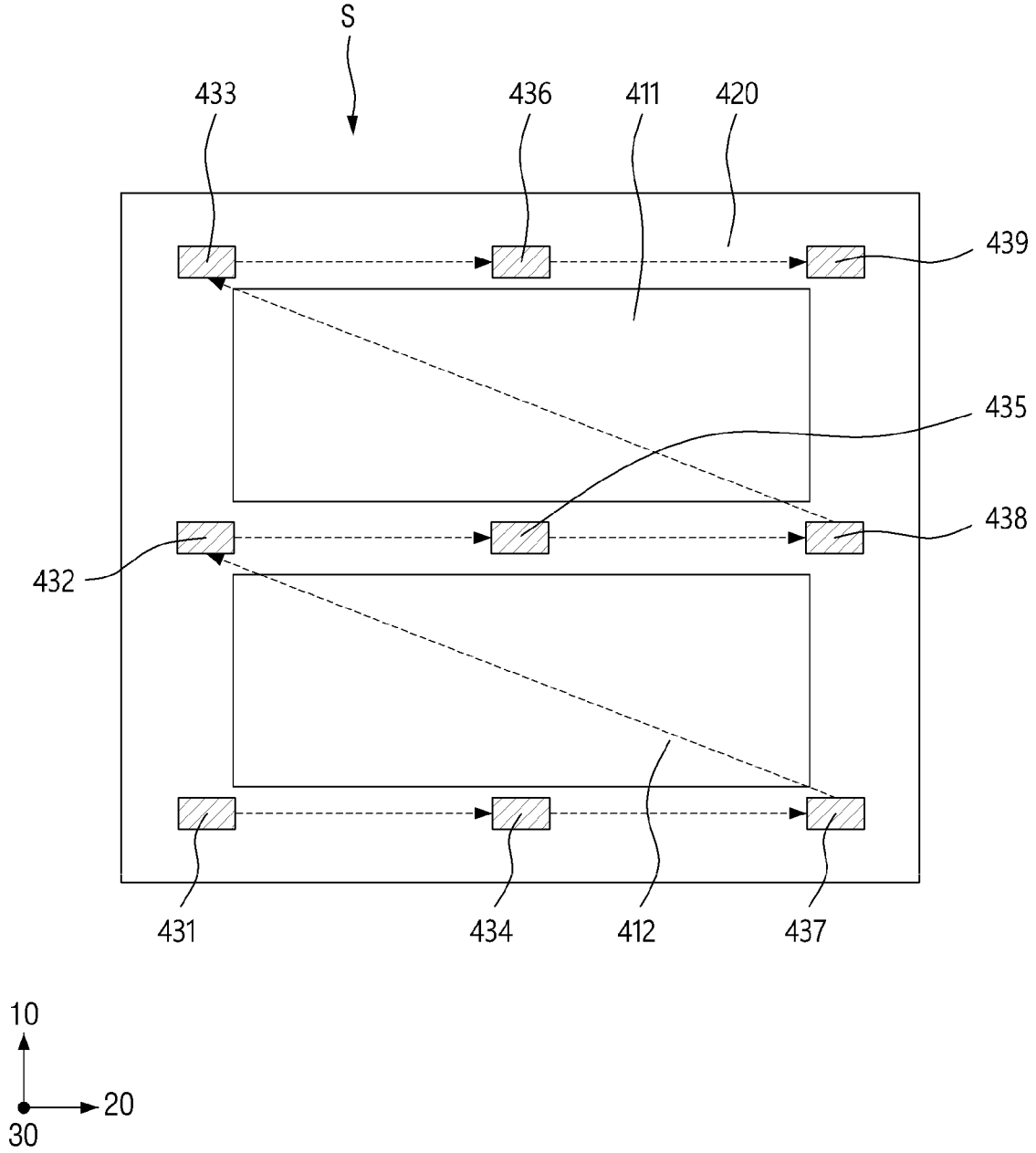

[FIG. 16]
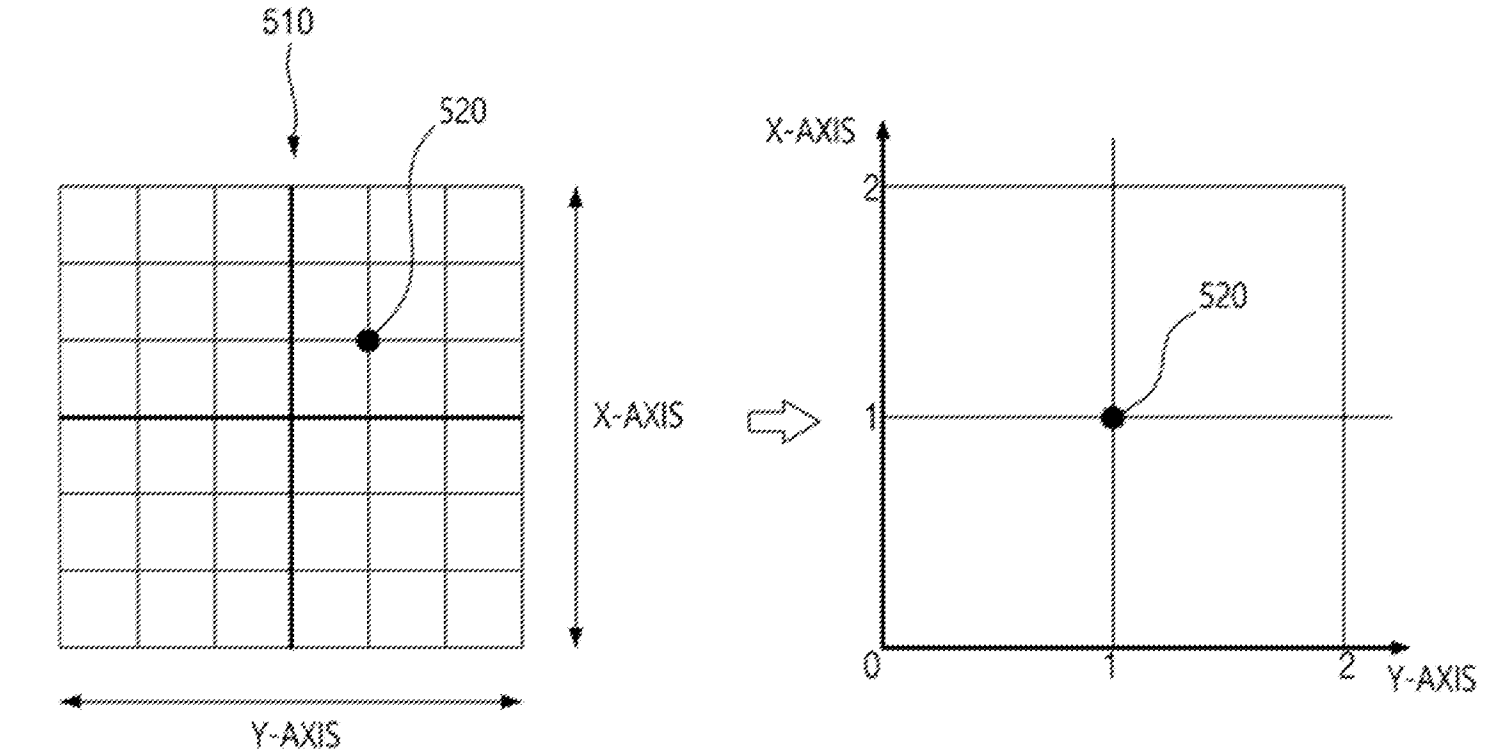

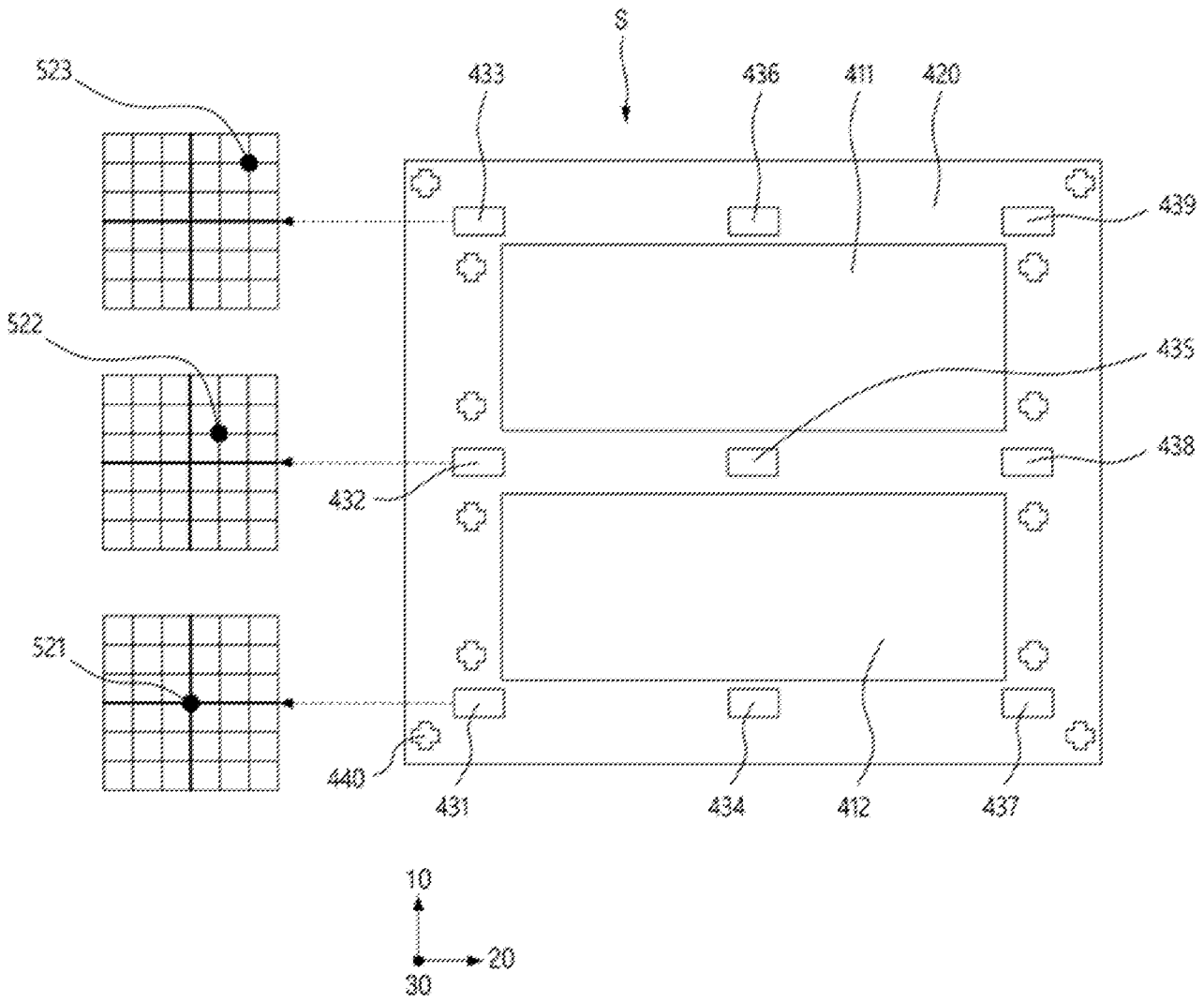
[FIG. 17]

[FIG. 18]
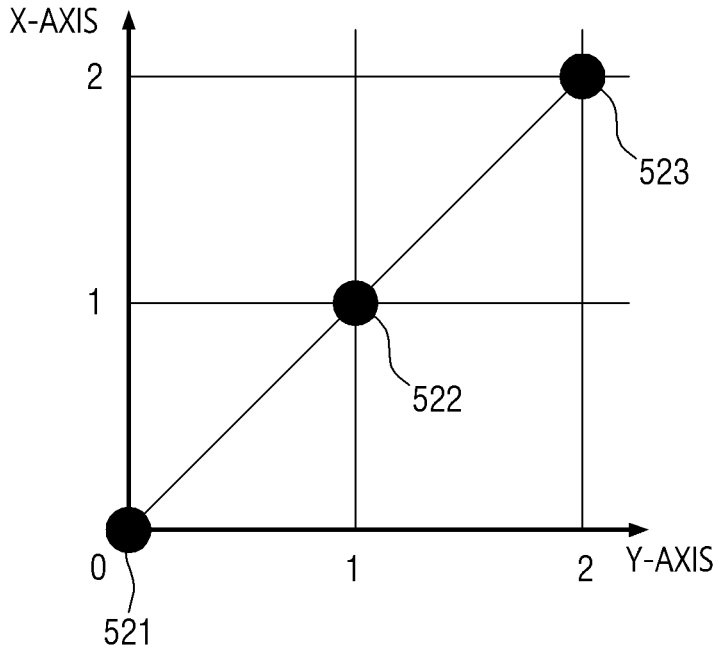

[FIG. 19]
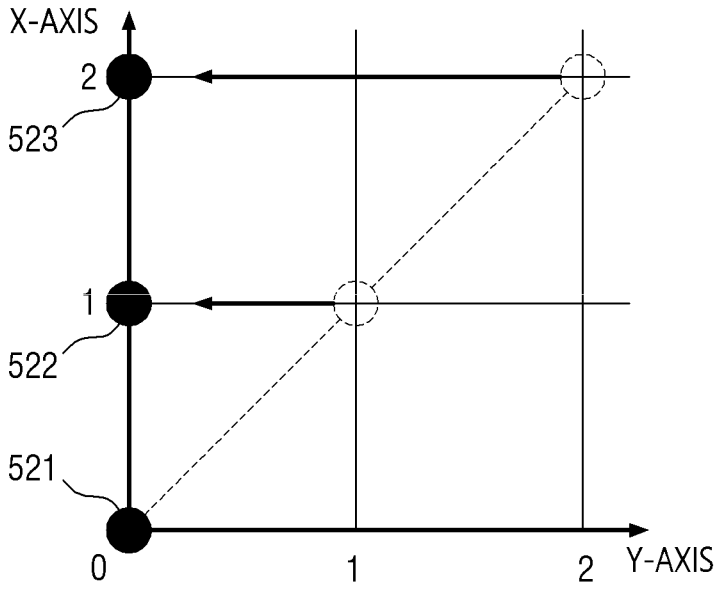

[FIG. 20]
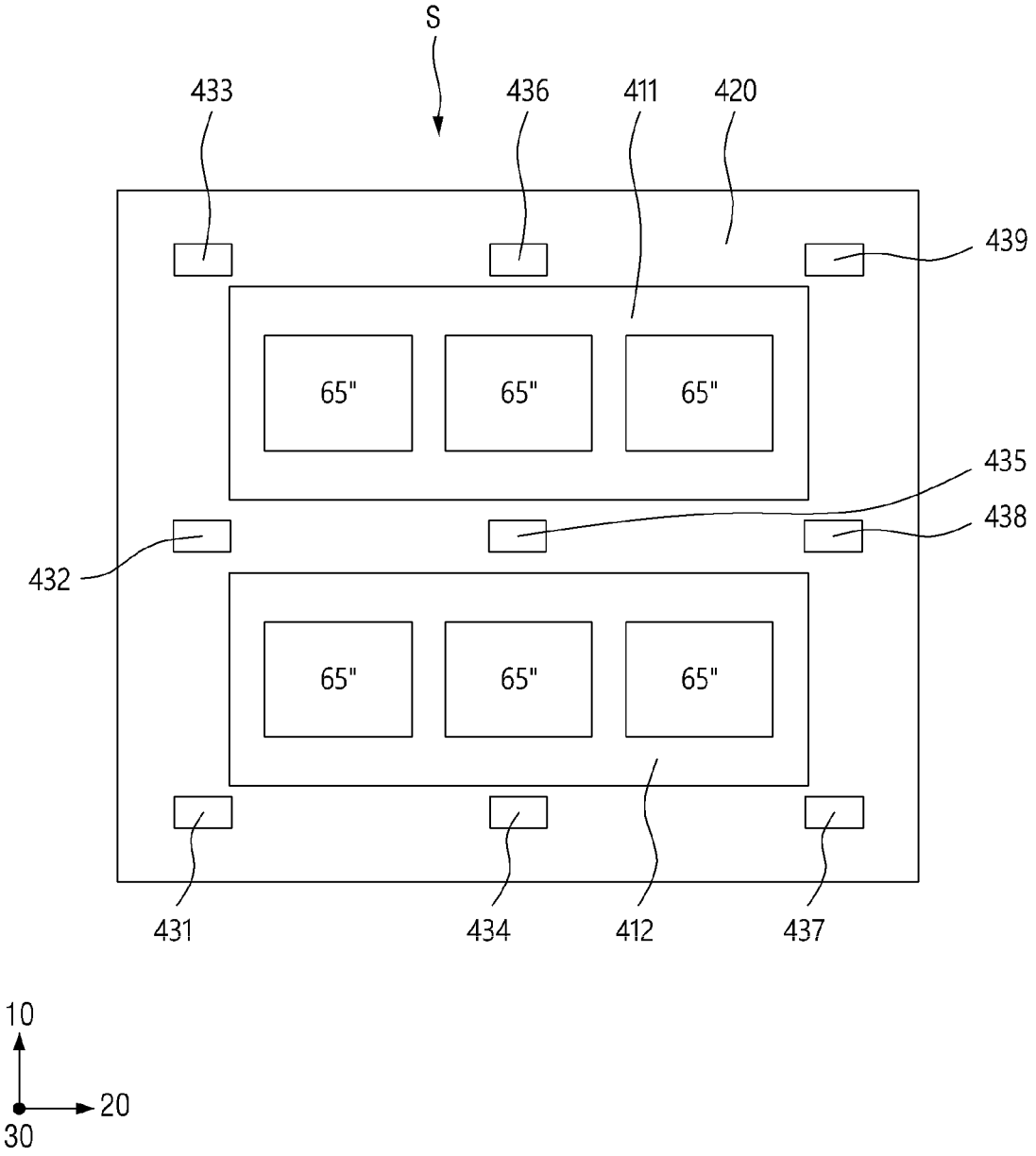

[FIG. 21]
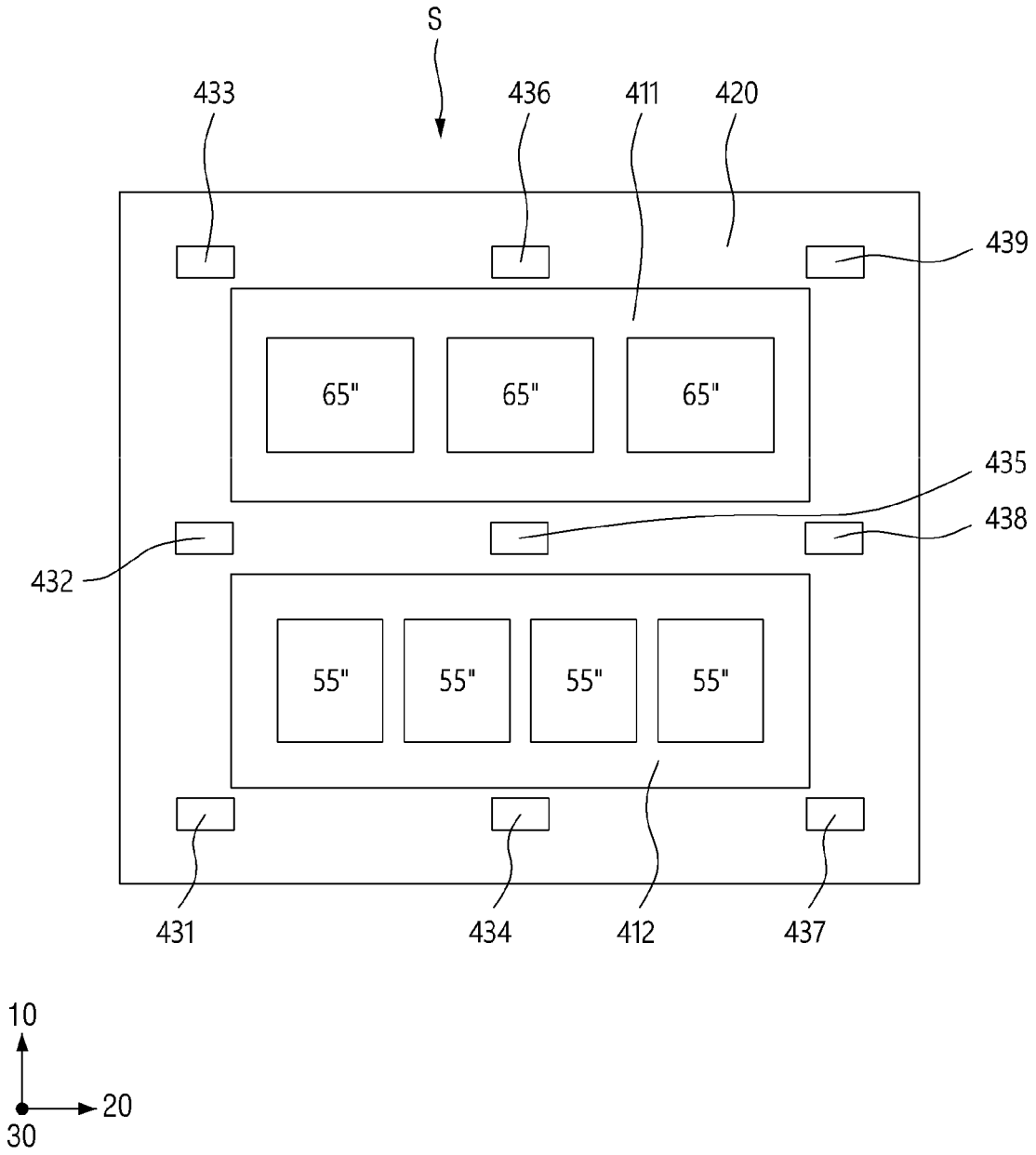

[FIG. 22]
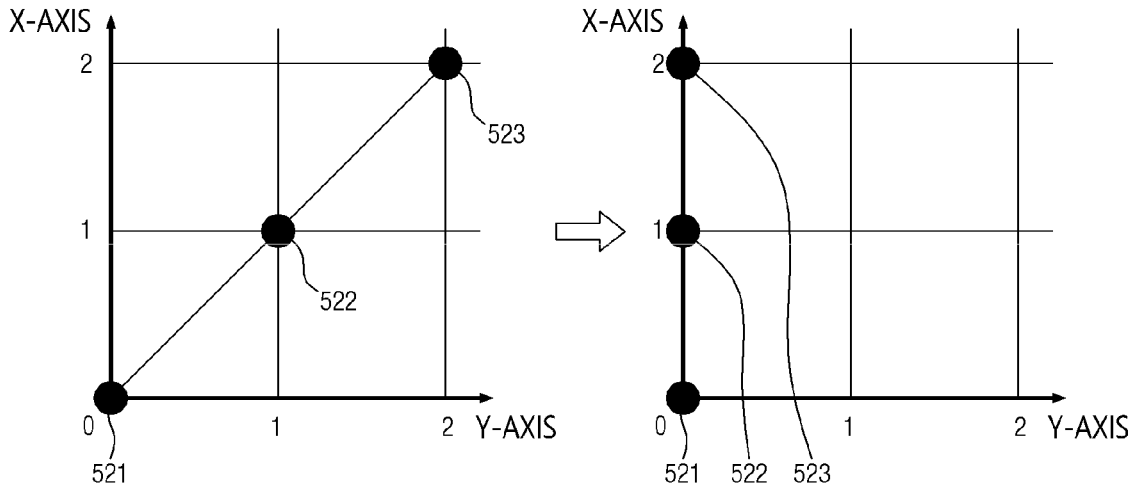

[FIG. 23]
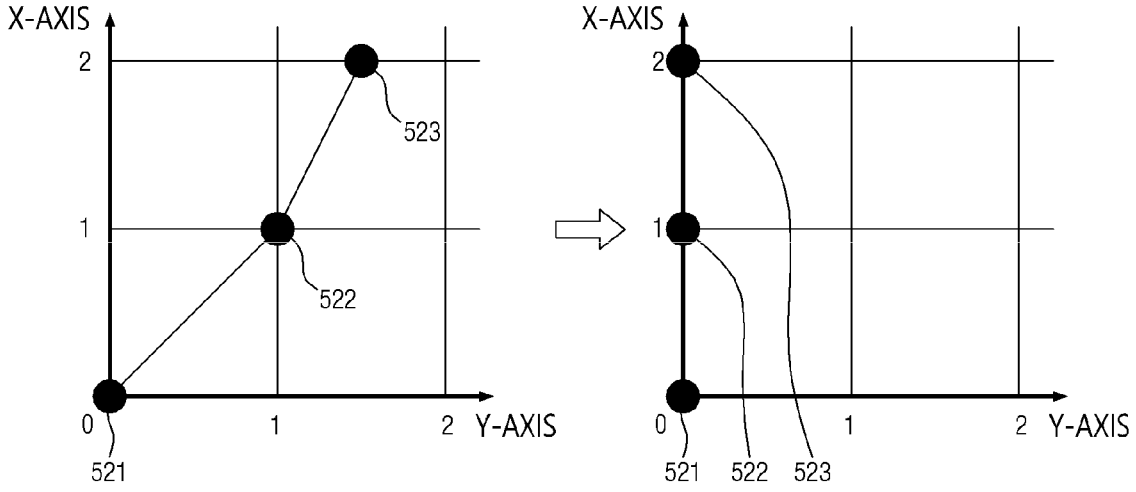

[FIG. 24]
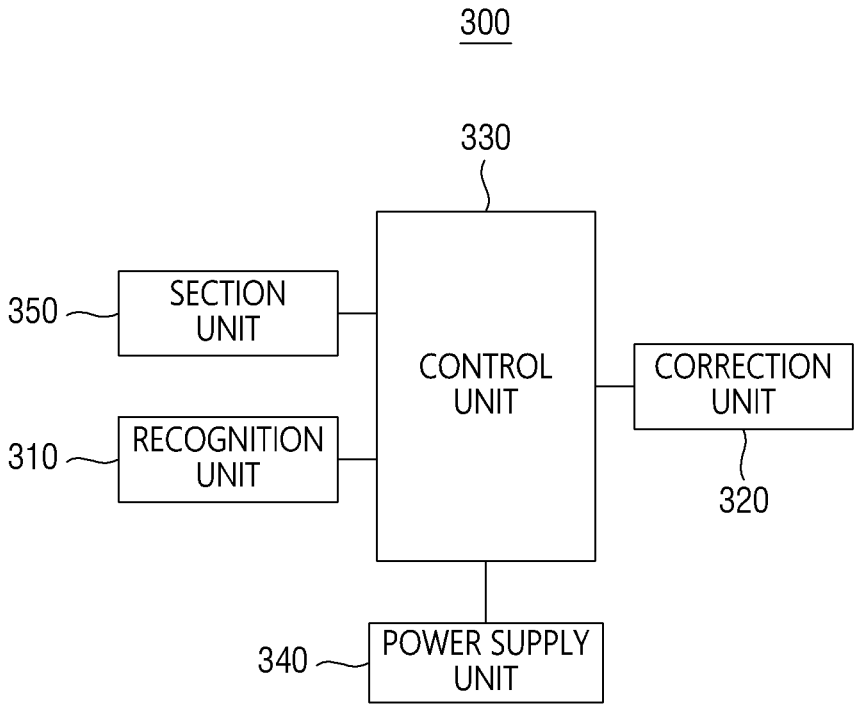

APPARATUS FOR CORRECTING IMPACT POINT OF INK AND SYSTEM FOR TREATING SUBSTRATE WITH THE APPARATUS

CROSS REFERENCE TO RELATED APPLICATION

This application claims the benefit of Korean Patent Application No. 10-2020-0083245, filed on Jul. 7, 2020, in the Korean Intellectual Property Office, the disclosure of which is incorporated herein by reference in its entirety.

FIELD OF THE INVENTION

The present invention relates to an ink impact point correction apparatus and a substrate treating system having the same. More specifically, it relates to an ink impact point correction apparatus used to manufacture a display device and a substrate treating system having the same.

BACKGROUND OF THE INVENTION

When performing a printing process (for example, RGB patterning) on a transparent substrate to manufacture display devices such as LCD panels, PDP panels, and LED panels, printing equipment having an inkjet head module may be used.

SUMMARY OF THE INVENTION

In order to correct and mitigate errors (e.g., translation errors, rotation errors, etc.) that affect the impact of individual droplets on the substrate in the transport path system, and accurately pattern R/G/B, calibration work is indispensable to cope with the mechanical defects of the printing equipment.

In order to improve the mechanical error, it is necessary to correct the impact for each glass position. Conventionally, for this purpose, a method of manually confirming the impact of ink through a vision camera after impacting ink on a water-repellent-treated glass was applied.

However, the above method may incur a cost burden because a water-repellent-treated glass is additionally required. Further, the above method may take a lot of time to complete the calibration work because the work time is very long, and it may be unsuitable for mass production of patterned products because the calibration value is manually recipe corrected.

An object to be solved in the present invention is to provide an ink impact point correction apparatus for automatically measuring and correcting an impact point of ink using a pattern on a substrate, on which a coordinate system is displayed, and a substrate treating system having the same.

The problems of the present invention are not limited to the problems mentioned above, and other problems that are not mentioned will be clearly understood by those skilled in the art from the following description.

One aspect of the ink impact point correction apparatus of the present invention for achieving the above object comprises a recognition unit for acquiring information on an impact point of ink at a plurality of points located on a substrate; and a correction unit for correcting a position of an ink discharge point on the substrate based on the information on the impact point, wherein a coordinate pattern in a form of a coordinate system is formed at the plurality of points.

Wherein the recognition unit may recognize coordinates of a droplet of the ink and acquire information on the impact point when the droplet of the ink is discharged on the coordinate pattern.

Wherein the correction unit, when coordinates of a plurality of ink droplets are acquired as information on the impact point, may calculate a slope based on the coordinates of the plurality of ink droplets, and correct the position of the ink discharge point based on the slope.

Wherein the correction unit, when coordinates of a plurality of ink droplets are acquired as information on the impact point, may correct the position of the ink discharge point so that all coordinate values of at least one axis in the coordinates of the plurality of ink droplets are 0.

Wherein the correction unit, when there are a plurality of cell areas on the substrate, may correct the position of the ink discharge point using any one of a first mode and a second mode based on relationship information between two neighboring cell areas.

Wherein the correction unit may correct the position of the ink discharge point using the first mode when correcting a pattern recipe to be commonly applied to the two neighboring cell areas, and correct the position of the ink discharge point using the second mode when correcting a pattern recipe to be differentially applied to the two neighboring cell areas.

Wherein the recognition unit, when the correction unit corrects the position of the ink discharge point using the first mode, may recognize the impact point at a plurality of points located outside the two neighboring cell areas, or the recognition unit, when the correction unit corrects the position of the ink discharge point using the second mode, may recognize the impact point at a plurality of points located outside the two neighboring cell areas and at least one point located between the two neighboring cell areas.

Wherein the correction unit may use at least one of information on whether applications having the same size are installed in the two neighboring cell areas, information on whether an application having thermal deformation is installed in the two neighboring cell areas, and information on whether an alignment is changed between the two neighboring cell areas as the relationship information.

Wherein the plurality of points may be formed in a dummy area, in which no cell area is formed on the substrate.

Wherein the plurality of points may be formed in the dummy area before the cell area is formed on the substrate, or after the cell area is formed on the substrate, and the plurality of points may be formed in the dummy area based on an alignment mark formed on the substrate when the plurality of points are formed in the dummy area before the cell area is formed on the substrate.

Wherein the recognition unit may recognize the impact point at the plurality of points arranged in a row in at least one direction on the substrate to acquire information on the impact point.

Wherein the recognition unit may recognize the impact point at two points located outside when recognizing the impact point at the plurality of points arranged in a row in one direction on the substrate.

Wherein the plurality of points may be selected by considering a moving direction of the substrate.

Wherein the plurality of points arranged in a direction different from the moving direction of the substrate may be selected.

Wherein the recognition unit may recognize the impact point at the plurality of points arranged in a row in at least two directions on the substrate, and the correction unit may correct a pattern recipe to be applied to a cell area on the substrate in at least two directions.

Wherein the correction unit may correct the position of the ink discharge point by controlling timing of discharging ink onto the substrate, or correct the position of the ink discharge point by correcting a position or posture of a device discharging ink onto the substrate, or correct the position of the ink discharge point by correcting a position or posture of the substrate.

Wherein the correction unit may correct the position of the ink discharge point before patterning RGB on the substrate.

The ink impact point correction apparatus may further comprise a selection unit for selecting a point on the substrate, to which ink is to be discharged.

Another aspect of the ink impact point correction apparatus of the present invention for achieving the above object comprise a recognition unit for acquiring information on an impact point of ink at a plurality of points located on a substrate; and a correction unit for correcting a position of an ink discharge point on the substrate based on the information on the impact point, wherein the correction unit, when there are a plurality of cell areas on the substrate, corrects the position of the ink discharge point using any one of a first mode and a second mode based on relationship information between two neighboring cell areas, wherein the correction unit corrects the position of the ink discharge point using the first mode when correcting a pattern recipe to be commonly applied to the two neighboring cell areas, wherein the correction unit corrects the position of the ink discharge point using the second mode when correcting a pattern recipe to be differentially applied to the two neighboring cell areas.

One aspect of the substrate processing system of the present invention for achieving the above object comprises a substrate support unit for supporting a substrate; a gantry unit movably installed on the substrate; an inkjet head module installed on the gantry unit and for discharging ink onto the substrate; and an ink impact point correction apparatus comprising a recognition unit for acquiring information on an impact point of ink at a plurality of points located on the substrate; and a correction unit for correcting a position of an ink discharge point on the substrate based on the information on the impact point, wherein a coordinate pattern in a form of a coordinate system is formed at the plurality of points.

Details of other embodiments are included in the detailed description and drawings.

BRIEF DESCRIPTION OF THE DRAWINGS

These and/or other aspects will become apparent and more readily appreciated from the following description of the embodiments, taken in conjunction with the accompanying drawings in which:

FIG. 1 is a perspective view schematically showing an internal structure of a substrate treating system;

FIG. 2 is a plan view schematically showing an internal structure of a substrate treating system;

FIG. 3 is a conceptual diagram schematically showing an internal configuration of an ink impact point correction apparatus according to an embodiment of the present invention;

FIG. 4 is a first exemplary view for describing an arrangement structure of a plurality of ink discharge points formed on a substrate according to an embodiment of the present invention;

FIG. 5 is a second exemplary view for describing an arrangement structure of a plurality of ink discharge points formed on a substrate according to an exemplary embodiment of the present invention;

FIG. 6 is a first exemplary view illustrating a method of forming a plurality of ink discharge points formed on a substrate according to an exemplary embodiment of the present invention;

FIG. 7 is a second exemplary view for describing a method of forming a plurality of ink discharge points formed on a substrate according to an exemplary embodiment of the present invention;

FIG. 8 is an exemplary diagram of a coordinate pattern installed at a plurality of points on a substrate according to an embodiment of the present invention;

FIG. 9 is a first exemplary view for describing a function of a recognition unit constituting an ink impact point correction apparatus according to an embodiment of the present invention;

FIG. 10 is a second exemplary view for describing a function of a recognition unit constituting an ink impact point correction apparatus according to an embodiment of the present invention;

FIG. 11 is a third exemplary view for describing a function of a recognition unit constituting an ink impact point correction apparatus according to an embodiment of the present invention;

FIG. 12 is a fourth exemplary view for describing a function of a recognition unit constituting an ink impact point correction apparatus according to an embodiment of the present invention;

FIG. 13 is a fifth exemplary view for describing a function of a recognition unit constituting an ink impact point correction apparatus according to an embodiment of the present invention;

FIG. 14 is a sixth exemplary view for describing a function of a recognition unit constituting an ink impact point correction apparatus according to an embodiment of the present invention;

FIG. 15 is a seventh exemplary view for describing the function of the recognition unit constituting the ink impact point correction apparatus according to an embodiment of the present invention;

FIG. 16 is an eighth exemplary view for describing the function of the recognition unit constituting the ink impact point correction apparatus according to an embodiment of the present invention;

FIG. 17 is a first exemplary view for describing a function of a correction unit constituting an ink impact point correction apparatus according to an embodiment of the present invention;

FIG. 18 is a second exemplary view for describing a function of a correction unit constituting an ink impact point correction apparatus according to an embodiment of the present invention;

FIG. 19 is a third exemplary view for describing the function of the correction unit constituting the ink impact point correction apparatus according to an embodiment of the present invention;

FIG. 20 is an exemplary diagram for describing a common mode applied to patterning of a cell area according to an embodiment of the present invention;

FIG. 21 is an exemplary diagram for describing a differential mode applied to patterning of a cell area according to an embodiment of the present invention;

FIG. 22 is a fourth exemplary view for describing a function of a correction unit constituting an ink impact point correction apparatus according to an embodiment of the present invention;

FIG. 23 is a fifth exemplary view for describing a function of a correction unit constituting an ink impact point correction apparatus according to an embodiment of the present invention; and FIG. 24 is a conceptual diagram schematically showing an internal configuration of an ink impact point correction apparatus according to another embodiment of the present invention.

DETAILED DESCRIPTION OF THE INVENTION

Hereinafter, preferred embodiments of the present invention will be described in detail with reference to the accompanying drawings. Advantages and features of the present invention, and methods for achieving them will be clarified with reference to embodiments described below in detail together with the accompanying drawings. However, the present invention is not limited to the embodiments disclosed below, but may be implemented in various different forms, and only the embodiments allow the publication of the present invention to be complete, and are provided to fully inform those skilled in the technical field to which the present invention pertains of the scope of the invention, and the invention is only defined by the scope of the claims. The same reference numerals refer to the same elements throughout the specification.

When elements are referred to as "on" or "above" of other elements, it includes not only when directly above of the other elements, but also other elements intervened in the middle. On the other hand, when elements are referred to as "directly on" or "directly above," it indicates that no other element is intervened therebetween.

The spatially relative terms "below," "beneath," "lower," "above," "upper," etc., as shown in figures, can be used to easily describe the correlation of components or elements with other components or elements. The spatially relative terms should be understood as terms including the different direction of the element in use or operation in addition to the direction shown in the figure. For example, if the element shown in the figure is turned over, an element described as "below" or "beneath" the other element may be placed "above" the other element. Accordingly, the exemplary term "below" can include both the directions of below and above. The element can also be oriented in other directions, so that spatially relative terms can be interpreted according to the orientation.

Although the first, second, etc. are used to describe various components, elements and/or sections, these components, elements and/or sections are not limited by these terms. These terms are only used to distinguish one component, element, or section from another component, element or section. Therefore, first component, the first element or first section mentioned below may be a second component, second element, or second section within the technical spirit of the present invention.

The terminology used herein is for describing the embodiments and is not intended to limit the present invention. In the present specification, the singular form also includes the plural form unless otherwise specified in the phrase. As used herein, "comprises" and/or "comprising" means that the elements, steps, operations and/or components mentioned above do not exclude the presence or additions of one or more other elements, steps, operations and/or components.

Unless otherwise defined, all terms (including technical and scientific terms) used in the present description may be used with meanings that can be commonly understood by those of ordinary skill in the art to which the present invention belongs. In addition, terms defined in a commonly used dictionary are not interpreted ideally or excessively unless explicitly defined specifically.

Hereinafter, exemplary embodiments of the present invention will be described in detail with reference to the accompanying drawings, and in the description with reference to the accompanying drawings, the same or corresponding elements are assigned the same reference numbers regardless of reference numerals, and the description overlapped therewith will be omitted.

Conventionally, in order to improve the mechanical error of printing equipment, ink is impacted onto water-repellent-treated glass, and then the distance between the ink and the actual pattern is manually measured through a vision camera, and the measured distance is manually reflected by recipe offset and then the printing process is performed.

However, in this method, since the water-repellent-treated glass should be separately provided, and the above procedure should be repeated before performing the printing process, the efficiency of product production may be degraded.

The present invention relates to an ink impact point correction apparatus for automatically measuring and correcting an impact point of ink using a pattern on a substrate, on which a coordinate system is displayed, and a substrate treating system having the same.

The ink impact point correction apparatus according to the present invention can measure and correct the impact point of ink in real time using a pattern, in which X coordinates and Y coordinates are displayed in the dummy area of the mass-produced glass, without a separate water-repellent glass. According to the present invention, the following effects can be obtained.

First, the working time can be shortened from 4 hours per day to 5 minutes, thereby improving the productivity of the equipment.

Second, it is possible to improve the product yield by automatically correcting the mechanical defects of the transport system, and prevent process defects in advance by monitoring the impact point during mass production.

Third, human errors can be eliminated with the auto tuning function, and accordingly, the quality of equipment can be improved.

Hereinafter, the present invention will be described in detail with reference to the drawings. First, a substrate treating system including an ink impact point correction apparatus will be described.

FIG. 1 is a perspective view schematically showing an internal structure of a substrate treating system, and FIG. 2 is a plan view schematically showing an internal structure of a substrate treating system.

The substrate treating system is to treat the substrate. Such a substrate treating system may be implemented as a printing equipment that discharges ink or the like onto a substrate using, for example, an inkjet head module. Hereinafter, a case where the substrate treating system is a printing equipment will be described as an example.

Referring to FIGS. 1 and 2, the printing equipment 100 may include a base 110, a substrate support unit 120, a gantry unit 130, a gantry moving unit 140, an inkjet head module 150, a head moving unit 160, a droplet discharge amount measuring unit 170, and a nozzle inspection unit 180.

The base 110 constitutes the body of the printing equipment 100. The base 110 may be provided in a rectangular parallelepiped shape having a predetermined thickness. Meanwhile, a substrate support unit 120 may be arranged on the upper surface of the base 110.

The substrate support unit 120 supports the substrate (S). The substrate support unit 120 may include a support plate 121, on which the substrate (S) is placed.

The support plate 121 is one, on which the substrate (S) is mounted. The support plate 121 may be a flat plate having a rectangular shape. Meanwhile, a rotation driving member 122 may be connected to the lower surface of the support plate 121.

The rotation driving member 122 rotates the support plate 121. The rotation driving member 122 may be implemented as a rotation motor for this purpose. The rotation driving member 122 may rotate the support plate 121 using a rotation center axis formed in a direction perpendicular to the support plate 121.

When the support plate 121 is rotated by the rotation driving member 122, the substrate (S) may also rotate along the support plate 121. For example, when the long side direction of the cell formed on the substrate (S), to which the droplet is to be applied, towards the second direction 20, the rotation driving member 122 may rotate the substrate so that the long side direction of the cell towards the first direction 10.

The linear driving member 123 linearly moves the support plate 121 and the rotation driving member 122. The linear driving member 123 may linearly move the support plate 121 and the rotation driving member 122 in the first direction 10.

The linear driving member 123 may include a slider 124 and a guide member 125. In this case, the rotation driving member 122 may be installed on the upper surface of the slider 124.

The guide member 125 may extend from the center of the upper surface of the base 110 in the first direction 10 as a longitudinal direction. A linear motor (not shown) may be embedded in the slider 124, and the slider 124 may be linearly moved in the first direction 10 along the guide member 125 by the linear motor.

The gantry unit 130 supports a plurality of inkjet head modules 150. The gantry unit 130 may be provided above the path through which the support plate 121 is moved.

The gantry unit 130 may be spaced apart from the upper surface of the base 110 in the upward direction. Further, the gantry unit 130 may be arranged such that its longitudinal direction towards the second direction 20.

The gantry moving unit 140 linearly moves the gantry unit 130 in the first direction 10. The gantry moving unit 140 may include a first moving unit 141 and a second moving unit 142.

The first moving unit 141 may be provided at one end of the gantry unit 130, and the second moving unit 142 may be provided at the other end of the gantry unit 130. In this case, the first moving unit 141 may slide along the first guide rail 211 provided on one side of the base 110, and the second moving unit 142 may slide along the second guide rail 212 provided on the other side of the base 110 to linearly move the gantry unit 130 in the first direction 10.

The inkjet head module 150 discharges droplets such as ink on the substrate (S). The inkjet head module 150 may be installed on the side surface of the gantry unit 130 and supported by the gantry unit 130.

The inkjet head module 150 may linearly move in the longitudinal direction of the gantry unit 130, that is, in the second direction 20 by the head moving unit 160, and may linearly move in the third direction 30. Further, the inkjet head module 150 may rotate about an axis parallel to the third direction 30 with respect to the head moving unit 160.

A plurality of inkjet head modules 150 may be provided on the gantry unit 130. Three inkjet head modules 150, for example, a first head unit 151, a second head unit 152, and a third head unit 153 may be provided. The plurality of inkjet head modules 150 may be coupled to the gantry unit 130 in a row, for example, in the second direction 20.

The inkjet head module 150 may include a plurality of nozzles (not shown) for discharging droplets and a nozzle plate (not shown), on which a plurality of nozzles are formed. For example, 128 nozzles or 256 nozzles may be provided to the inkjet head module 150.

The inkjet head module 150 may be provided with a number of piezoelectric elements corresponding to a plurality of nozzles. The droplet discharge amount of the plurality of nozzles may be independently adjusted by controlling the voltage applied to the piezoelectric element.

The head moving unit 160 linearly moves the inkjet head module 150. The head moving unit 160 may be provided in the printing equipment 100 corresponding to the number of inkjet head modules 150. For example, if three inkjet head units 150, such as a first head unit 151, a second head unit 152, and a third head unit 153, are provided, three head moving units 160 may also be provided.

Meanwhile, a single head moving unit 160 may be provided, and in this case, the inkjet head module 150 does not move individually, but may move together at the same time.

The droplet discharge amount measuring unit 170 measures the droplet discharge amount of the inkjet head module 150. The droplet discharge amount measuring unit 170 may be arranged on one side of the substrate support unit 120 on the base 110.

The droplet discharge amount measuring unit 170 may measure the amount of droplets discharged from all nozzles for each inkjet head module 150. Through the measurement of the droplet discharge amount of the inkjet head module 150, it is possible to macroscopically check whether or not all nozzles of the inkjet head module 150 are abnormal. That is, when the droplet discharge amount of the inkjet head module 150 is out of the reference value, it can be seen that at least one of the inkjet head modules 150 is abnormal.

The inkjet head module 150 may be moved in the first direction 10 and the second direction 20 by the gantry moving unit 140 and the head moving unit 160 to be located above the droplet discharge amount measuring unit 170. The head moving unit 160 may move the inkjet head module 150 in the third direction 30 to adjust a vertical distance between the inkjet head module 150 and the droplet discharge amount measuring unit 170.

The nozzle inspection unit 180 checks whether or not an individual nozzle provided to the inkjet head module 150 is abnormal. The nozzle inspection unit 180 may check whether or not an individual nozzle is abnormal through, for example, optical inspection.

As a result of macroscopic checking on the abnormality of the nozzle in the droplet discharge amount measurement unit 170, when it is determined that there is abnormality in an unspecified nozzle, inspection of all nozzles may proceed while checking whether an individual nozzle is abnormal.

The nozzle inspection unit 180 may be arranged on one side of the substrate support unit 120 on the base 110. The inkjet head module 150 may be moved in the first direction 10 and the second direction 20 by the gantry moving unit 140 and the head moving unit 160 to be located above the nozzle inspection unit 180. The head moving unit 160 may move the inkjet head module 150 in the third direction 30 to adjust a vertical distance between the inkjet head module 150 and the nozzle inspection unit 180.

Meanwhile, the printing equipment 100 may further include a droplet supply device 190.

The droplet supply device 190 may be installed on the upper and side portions of the gantry unit 130. The droplet supply device 190 may include a droplet supply module 191 and a pressure control module 192.

The droplet supply module 191 supplies liquid such as ink to the inkjet head module 150. After receiving the liquid from a storage tank (not shown) storing the liquid, the droplet supply module 191 may supply the liquid to the inkjet head module 150.

The pressure control module 192 controls the pressure of the droplet supply module 191. The pressure control module 192 may control the pressure of the droplet supply module 191 by providing positive pressure or negative pressure to the droplet supply module 191.

Meanwhile, the droplet supply module 191 and the pressure control module 192 may be coupled to the gantry unit 130.

In order to improve the mechanical errors (e.g., translation errors, rotation errors, etc.) of the printing equipment 100, impact correction for each position of the substrate is required. The substrate treating system may be equipped with an ink impact point correction apparatus for this purpose.

The ink impact point correction apparatus can automatically measure and correct the impact point of ink in order to cope with the mechanical defects of the printing equipment. Ink impact errors may be caused by mechanical defects in the transport system (e.g., gantry unit 130). In this embodiment, in spite of the mechanical defects of the transport system, the above errors can be corrected to improve the printing accuracy for the substrate. The ink impact point correction apparatus can be applied to correct for non-orthogonal mismatch in the coordinate system.

Hereinafter, an ink impact point correction apparatus will be described.

FIG. 3 is a conceptual diagram schematically showing the internal configuration of an ink impact point correction apparatus according to an embodiment of the present invention.

Referring to FIG. 3, the ink impact point correction apparatus 300 may include a recognition unit 310, a correction unit 320, and a control unit 330. The ink impact point correction apparatus 300 may further include a power supply unit 340 and a selection unit 350. This will be described later with reference to FIG. 24.

When ink is discharged to a plurality of points on the substrate (S) (e.g., a glass substrate for manufacturing a display device) by the inkjet head module 150, the recognition unit 310 performs a function of acquiring position information about the impact point of the ink at each ink discharge point. To this end, the recognition unit 310 may recognize the impact point of ink at each ink discharge point.

The recognition unit 310 may be implemented as a vision camera that performs a recognition function. In this case, the control unit 330 may be implemented as a computer device (or software installed in the computer device) that controls the operation of the recognition unit 310. Meanwhile, the recognition unit 310 may be understood as a concept including a vision camera and a computer device that controls the operation of the vision camera.

A plurality of points formed on the substrate (S) are for accurately patterning RGB on the substrate (S). The inkjet head module 150 may discharge ink to such a plurality of points.

The plurality of points may be formed in a dummy area on the substrate (S), in which no cell is formed. For example, as shown in FIG. 4, when there are two cell areas 411 and 412 on the substrate (S), nine points 431 to 439 may be formed in the dummy area 420, which is an area other than the two cell areas 411 and 412. In the above, the cell areas 411 and 412 refer to areas, in which RGB is patterned. FIG. 4 is a first exemplary view for describing an arrangement structure of a plurality of ink discharge points formed on a substrate according to an embodiment of the present invention.

Some of the plurality of points may be formed adjacent to the alignment mark 440. For example, as shown in FIG. 4, a first point 431, a second point 432, a third point 433, a seventh point 437, an eighth point 438, and a ninth point 439 and the like may be formed adjacent to the alignment mark 440, and the fourth point 434, the fifth point 435, and the sixth point 436 may not be formed adjacent to the alignment mark 440.

However, this embodiment is not limited thereto. It is also possible that the entire plurality of points may be formed adjacent to the alignment mark 440. For example, as shown in FIG. 5, a first point 431, a second point 432, a third point 433, a fourth point 434, a fifth point 435, and a sixth point 436 and the like may be formed adjacent to the alignment mark 440. FIG. 5 is a second exemplary view for describing an arrangement structure of a plurality of ink discharge points formed on a substrate according to an exemplary embodiment of the present invention.

A plurality of points formed in the dummy area 420 may be formed after the cell areas 411 and 412 are formed on the substrate (S) as shown in FIG. 6. In this case, a plurality of points may be formed on the area adjacent to the cell areas 411 and 412. The plurality of points may be formed in consideration of the alignment mark 440 as well. For example, a plurality of points may be formed on the area adjacent to the cell areas 411 and 412 and the alignment mark 440. FIG. 6 is a first exemplary view for describing a method of forming a plurality of ink discharge points formed on a substrate according to an exemplary embodiment of the present invention.

However, this embodiment is not limited thereto. A plurality of points may be formed before forming the cell areas 411 and 412 on the substrate (S) as shown in FIG. 7. In this case, a plurality of points may be formed on the area adjacent to the alignment mark 440. FIG. 7 is a second exemplary view for describing a method of forming a plurality of ink discharge points formed on a substrate according to an exemplary embodiment of the present invention.

Meanwhile, in the examples of FIGS. 4 to 7, it has been described that two cell areas 411 and 412 are formed on the substrate (S). However, this embodiment is not limited thereto. Only one cell area may be formed on the substrate (S), or three or more cell areas may be formed.

In order for the recognition unit 310 to recognize the impact point of ink at each ink discharge point, the inkjet head module 150 should discharge ink to each point on the substrate (S). In this embodiment, before the inkjet head module 150 performs a printing process on the two cell areas 411 and 412, a plurality of inks may be discharged on the substrate (S). In this embodiment, through this, it is possible to obtain an effect of improving the printing precision of the substrate.

When recognizing the impact point of ink at each ink discharge point, the recognition unit 310 may recognize the impact point of ink using a coordinate pattern installed at each ink discharge point.

The coordinate pattern may be implemented as a coordinate system composed of an X-axis coordinate value and a Y-axis coordinate value. The coordinate pattern may be implemented, for example, in a Cartesian coordinate system as shown in FIG. 8. FIG. 8 is an exemplary diagram of a coordinate pattern installed at a plurality of points on a substrate according to an embodiment of the present invention.

The recognition unit 310 may recognize the impact point of ink at ink discharge points arranged in a row in the first direction 10 among a plurality of points on the substrate (S). In this case, the recognition unit 310 may recognize the impact point of the ink by using the entire points arranged in a row in the first direction 10 as the ink discharge points.

For example, as shown in FIG. 9, when the first points 431 to ninth points 439 are formed on the substrate (S), the recognition units 310 may recognize the impact point of the ink by using three points (first point 431 to third point 433, or fourth point 434 to sixth point 436, or seventh point 437 to ninth point 439) arranged in a row in the first direction 10 as the ink discharge points. FIG. 9 is a first exemplary view for describing a function of a recognition unit constituting an ink impact point correction apparatus according to an embodiment of the present invention.

However, this embodiment is not limited thereto. The recognition unit 310 may recognize the impact point of ink by using some of the points arranged in a row in the first direction 10 as the ink discharge points.

For example, as shown in FIG. 10, the recognition unit 310 may recognize the impact point of ink by using two points (first point 431 and third point 433, the fourth point 434 and the sixth point 436, or the seventh point 437 and the ninth point 439)) located the outside among three points arranged in a row in the first direction 10 as the ink discharge points. FIG. 10 is a second exemplary view for describing the function of the recognition unit constituting the ink impact point correction apparatus according to an embodiment of the present invention.

The recognition unit 310 may recognize the impact point of ink at ink discharge points arranged in a row in the second direction 20 among a plurality of points on the substrate (S). In this case, the recognition unit 310 may recognize the impact point of the ink by using the entire points arranged in a row in the second direction 20 as the ink discharge points.

For example, as shown in FIG. 11, when the first points 431 to ninth points 439 are formed on the substrate (S), the recognition units 310 may recognize the impact point of ink by using three points (first point 431 and fourth point 434 and seventh point 437, or second point 432 and fifth point 435 and eighth point 438, or the third point 433 and the sixth point 436, and the ninth point 439) arranged in a row in the second direction 20 as the ink discharge points. FIG. 11 is a third exemplary view for describing a function of a recognition unit constituting an ink impact point correction apparatus according to an embodiment of the present invention.

However, this embodiment is not limited thereto. The recognition unit 310 may recognize the impact point of ink by using some of the points arranged in a row in the second direction 20 as the ink discharge points.

For example, as shown in FIG. 12, the recognition unit 310 may recognize the impact point of ink by using two points (first point 431 and seventh point 437, or the second point 432 and the eighth point 438, or the third point 433 and the ninth point 439) located the outside among three points arranged in a row in the second direction 20 as the ink discharge points. FIG. 12 is a fourth exemplary view for describing a function of a recognition unit constituting an ink impact point correction apparatus according to an embodiment of the present invention.

The recognition unit 310 may recognize the impact point of ink at a predetermined number of ink discharge points among a plurality of points on the substrate (S). In this case, the recognition unit 310 may recognize the impact point of the ink at the ink discharge point selected in consideration of the moving direction of the substrate (S).

For example, as shown in FIG. 13, when the moving direction of the substrate (S) is the second direction 20, the recognition unit 310 may recognize the impact point of ink by using a plurality of points arranged in a row is the first direction 10 that is a direction perpendicular to the second direction 20 as the ink discharge points.

Further, the recognition unit 310 may recognize the impact point of ink by using a plurality of points formed at the rear end of the moving substrate (S) as the ink discharge points. That is, the recognition unit 310 may recognize the impact point of the ink by using three points (that is, the first point 431 to the third point 433) formed at the rear end of the substrate (S) among a plurality of points arranged in a row in the first direction 10 as the ink discharge points. FIG. 13 is a fifth exemplary view for describing a function of a recognition unit constituting an ink impact point correction apparatus according to an embodiment of the present invention.

As described above, the recognition unit 310 may recognize the impact point of ink by using some of the plurality of points formed on the substrate (S) as ink discharge points. However, this embodiment is not limited thereto. The recognition unit 310 may recognize the impact point of ink by using the entire plurality of points formed on the substrate (S) as ink discharge points.

When the recognition unit 310 recognizes the entire plurality of points formed on the substrate (S) as the ink discharge points, the entire plurality of points may be recognized as the ink discharge points by considering the first direction 10 and the second direction 20 in the order of the first direction 10 and the second direction 20.

When recognizing the entire plurality of points as the ink discharge points in the order of the first direction 10 and the second direction 20, for example, as shown in FIG. 14, the recognition unit 310 may firstly recognize three points (first point 431 to third point 433) arranged in a row in the first direction 10 as ink discharge points in turn, and then move in the second direction 20 and secondly recognize other three points (fourth point 434 to sixth point 436) arranged in a row in the first direction 10 as ink discharge points in turn, and move back in the second direction 20 and finally recognize another three points (seventh points 437 to ninth points 439) arranged in a row in the first direction 10 as ink discharge points in turn.

In this embodiment, the recognition unit 310 may recognize the entire plurality of points as ink discharge points in the order of the seventh point 437 to the ninth point 439, the fourth point 434 to the sixth point 436, and the first point 431 to the third point 433. FIG. 14 is a sixth exemplary view for describing a function of a recognition unit constituting an ink impact point correction apparatus according to an embodiment of the present invention.

When the recognition unit 310 recognizes the entire plurality of points formed on the substrate (S) as ink discharge points, it is also possible to recognize the entire plurality of points as ink discharge points in consideration of the first direction 10 and the second direction 20 in the order of the second direction 20 and the first direction 10.

When recognizing the entire plurality of points as ink discharge points in the order of the second direction 20 and the first direction 10, for example, as shown in FIG. 15, the recognition unit 310 may firstly recognize three points (first point 431, fourth point 434 and seventh point 437) arranged in a row in the second direction 20 as ink discharge points in turn, and then move in the first direction 10 and secondly recognize other three points (second point 432, fifth point 435, and eighth point 438) arranged in a row in the second direction 10 as the ink discharge points in turn, and move back in the first direction 20 and finally recognize another three points (third points 433, sixth point 436, and ninth points 439) arranged in a row in the second direction 10 as ink discharge points in turn.

In this embodiment, the recognition unit 310 may recognize the entire plurality of points as ink discharge points in the order of the third point 433, the sixth point 436, the ninth point 439, and the second point 432, the fifth point 435, the eighth point 438, and the first point 431, the fourth point 434, the seventh point 437. FIG. 15 is a seventh exemplary view for describing the function of the recognition unit constituting the ink impact point correction apparatus according to an embodiment of the present invention.

On the other hand, when the recognition unit 310 recognizes the impact point of ink by using the entire plurality of points formed on the substrate (S) as the ink discharge points, it is also possible to recognize the impact point of the ink by randomly using the entire plurality of points as the ink discharge points.

As described above, the recognition unit 310 may move in at least one of the first direction 10 and the second direction 20 to recognize a plurality of ink discharge points. Hereinafter, a case where the recognition unit 310 moves in the first direction 10 to recognize a plurality of ink discharge points will be described as an example.

As described above, the recognition unit 310 may recognize the impact point of ink by using a coordinate pattern installed at each ink discharge point. When the inkjet head module 150 discharges ink onto a coordinate pattern installed at an ink discharge point, the recognition unit 310 may acquire the position information of the impact point of the ink based on the position information of the ink droplets on the coordinate pattern.

For example, when the ink droplet 520 is discharged on the coordinate pattern 510 as shown in the left view of FIG. 16, the recognition unit 310 may recognize that the X-axis coordinate value and the Y-axis coordinate value are each 1, as shown in the right view of FIG. 16. In this case, the recognition unit 310 may acquire (1, 1) as the position information of the impact point of the ink. FIG. 16 is an eighth exemplary view for describing the function of the recognition unit constituting the ink impact point correction apparatus according to an embodiment of the present invention.

It will be described again with reference to FIG. 3.

When the position information on the impact point of the ink is acquired by the recognition unit 310, the correction unit 320 performs a function of correcting the position of the ink discharge point based on this information. In this case, the correction unit 320 may correct the position of the ink discharge point in real time and/or automatically based on the position information of the impact point of the ink.

For example, when ink droplets 521, 522, 523 are sequentially discharged on the coordinate patterns 511, 512, 513 of the first point 431, the second point 432, and the third point 433 as shown in FIG. 17, the recognition unit 310 may acquire position information of the first ink droplet 521, position information of the second ink droplet 522, and position information of the third ink droplet 523 as (0, 0), (1, 1) and (2, 2), respectively. Then, the correction unit 320 may linearly analyze the data acquired by the recognition unit 310 to measure a slope, and automatically correct a pattern recipe to correct the position of the ink discharge point. FIG. 17 is a first exemplary view for describing a function of a correction unit constituting an ink impact point correction apparatus according to an embodiment of the present invention.

When measuring the slope by linearly analyzing the data acquired by the recognition unit 310, if position information of the first ink droplet 521, position information of the second ink droplet 522, and position information of the third ink droplet 523 are acquired as (0,0), (1,1) and (2,2), respectively, as shown in FIG. 17, the correction unit 320 may measure the slope of a line segment connecting position information of the three ink droplets 521, 522, and 523 on the coordinate patterns 511, 512 and 513, as shown in FIG. 18. FIG. 18 is a second exemplary view for describing a function of a correction unit constituting an ink impact point correction apparatus according to an embodiment of the present invention.

Further, when the position of the ink discharge point is corrected by automatically correcting the pattern recipe, the correction unit 320 may correct the position of the ink discharge point so that the position information of the three ink droplets 521, 522 and 523 have the slope of line segment of (0, 0), (1, 0), (2, 0), respectively, as shown in FIG. 19 when the slope of the line segment connecting the position information of the three ink droplets 521, 522, 523 on the coordinate patterns 511, 512, 513 is measured as shown in FIG. 18. The correction unit 320 may correct the position of the ink discharge points so that the position information of the three ink droplets 521, 522, and 523 are all (0, 0). FIG. 19 is a third exemplary view for describing the function of the correction unit constituting the ink impact point correction apparatus according to an embodiment of the present invention.

The correction unit 320 may be implemented with software (or a computer device that executes such software) that determines the discharge timing of ink and corrects the position of the ink discharge point. However, this embodiment is not limited thereto. The correction unit 320 may be implemented as a device (e.g., a jetting drive) that discharges ink at a discharge timing determined according to the control of the computer device.

Meanwhile, the correction unit 320 may be implemented as a device (e.g., an axis movement control unit) that corrects the position of the ink discharge point by controlling the position and posture of the equipment. In this case, the correction unit 320 may correct the position of the ink discharge point by controlling the position and posture of the gantry unit 130 or the inkjet head module 150. Further, the correction unit 320 may control the position and posture of the substrate (S) to correct the position of the ink discharge point.

Meanwhile, when the correction unit 320 is implemented as a jetting drive, an axis movement control unit, or the like, the control unit 330 may be implemented as software or a computer device that executes such software. However, the present embodiment is not limited thereto, and the correction unit 320 may cover not only the jetting drive, the axis movement control unit, etc., but also software controlling them (that is, the position of the ink discharge point can be corrected by determining the discharge timing of ink).

As described above, one cell area may be formed on the substrate (S), but a plurality of cell areas may be formed. Hereinafter, when a plurality of cell areas are formed on the substrate (S), how the correction unit 320 corrects the position of the ink discharge point will be described.

Hereinafter, a case where two cell areas, that is, a first cell area 411 and a second cell area 412, are formed on the substrate (S), and the first point 431, the second point 432 and the third point 433 are formed in the first direction 10 as ink discharge points will be described as an example.

In the above, the first point 431 refers to an ink discharge point formed outside the second cell area 412, that is, between one boundary of the substrate (S) and the second cell area 412. Further, the second point 432 refers to an ink discharge point formed between the first cell area 411 and the second cell area 412, and the third point 433 refers to an ink discharge point formed outside the first cell area 411, that is, between the other boundary of the substrate (S) and the first cell area 411.

The correction unit 320 may correct the position of the ink discharge point based on whether any of the common mode and the differential mode is applied to the two cell areas 411 and 412.

The common mode means glass printing mode. When the first cell area 411 and the second cell area 412 are formed on the substrate (S), and the common mode is applied to the two cell areas 411 and 412, the first cell area 411 and the second cell area 412 may be patterned with RGB in the same manner. The common mode may be applied, for example, when panels having the same size are formed in the first cell area 411 and the second cell area 412 as shown in FIG. 20. FIG. 20 is an exemplary diagram for describing a common mode applied to patterning of a cell area according to an embodiment of the present invention.

The differential mode means a printing mode for each cell. When the first cell area 411 and the second cell area 412 are formed on the substrate (S), and the differential mode is applied to the two cell areas 411 and 412, the first cell area 411 and the second cell area 412 may be patterned with RGB in different ways. The differential mode may be applied, for example, when panels having different sizes are formed in the first cell area 411 and the second cell area 412 as shown in FIG. 21. FIG. 21 is an exemplary diagram for describing a differential mode applied to patterning of a cell area according to an embodiment of the present invention.

As shown in the example of FIG. 21, the differential mode may be considered when a large area application is applied to one cell area compared to another cell area. However, this embodiment is not limited thereto. The differential mode may be considered when an application with a lot of deformation (for example, an application having a large thermal deformation) is applied to at least one of the two cell areas, and the differential mode also may be considered when there are some changes such as change of the alignment between the two cell areas.

When the common mode is applied to the two cell areas 411 and 412, the correction unit 320 may correct a pattern recipe to be commonly applied to the two cell areas 411 and 412 automatically and/or in real-time based on the position information on ink droplets at a plurality of ink discharge points formed outside the two cell areas 411 and 412.

For example, when the position information of the first ink droplet 521 impacted on the first point 431 is (0, 0), and the position information of the second ink droplet 522 impacted on the second point 432 is (1, 1), and the position information of the third ink droplet 523 impacted on the third point 433 is (2, 2), the correction unit 320 may correct a pattern recipe to be commonly applied to the two cell areas 411 and 412 by correcting the position of each ink discharge point based on the position information of the first ink droplet 521 and the position information of the third ink droplet 523.

That is, as shown in FIG. 22, the correction unit 320 may correct a pattern recipe to be commonly applied to the two cell areas 411 and 412 by correcting the position of each ink discharge point so that the position information of the first ink droplet 521 and the position information of the third ink droplet 523 have the slope of line segments of (0, 0) and (2, 0), respectively. FIG. 22 is a fourth exemplary view for describing a function of a correction unit constituting an ink impact point correction apparatus according to an embodiment of the present invention.

When the differential mode is applied to the two cell areas 411 and 412, the correction unit 320 may correct a pattern recipe to be differentially applied to the two cell areas 411 and 412 automatically and/or in real-time based on position information of ink droplets at a plurality of ink discharge points formed outside the two cell areas 411 and 412 and between the two cell areas 411 and 412.

For example, when the position information of the first ink droplet 521 impacted on the first point 431 is (0, 0), and the position information of the second ink droplet 522 impacted on the second point 432 is (1, 1), and the position information of the third ink droplet 523 impacted on the third point 433 is (2, 1.5), the correction unit 320 may correct the pattern recipe to be differentially applied to the two cell areas 411 and 412 by correcting the position of each ink discharge point based on the position information of the first ink droplet 521, the position information of the second ink droplet 522 and the position information of the third ink droplet 523.

That is, as shown in FIG. 23, the correction unit 320 may firstly correct the pattern recipe to be applied to the second cell area 412 by correcting the position of each ink discharge point so that the position information of the first ink droplet 521 and the position information of the second ink droplet 522 have the slope of the line segments of (0, 0) and (1, 0), respectively. And, the correction unit 320 may secondly correct the pattern recipe to be applied to the first cell area 411 by correcting the position of each ink discharge point so that the position information of the second ink droplet 522 and the position information of the third ink droplet have the slope of the line segment of (1, 0) and (2, 0), respectively. FIG. 23 is a fifth exemplary view for describing a function of a correction unit constituting an ink impact point correction apparatus according to an embodiment of the present invention.

When the correction unit 320 corrects the position of the ink discharge point using any one of a common mode and a differential mode, it may be possible to correspond to a multi-model glass (MMG) according to an application change. Here, MMG refers to a case, in which panels of different sizes (for example, a 65-inch panel and a 55-inch panel) are produced in the two cell areas 411 and 412.

In this embodiment, since the coordinate pattern can be used for the dummy area of the mass-produced glass, there is an advantage that the recipe can be corrected at any time during mass production. For example, there is an advantage that such a recipe check and correction are possible in the first glass for every cassette unit (e.g., 20 glasses).

In the above, when two cell areas are formed on the substrate (S), how the correction unit 320 corrects the position of the ink discharge point has been described. However, in this embodiment, three or more cell areas may be formed on the substrate (S).

In this case, the two neighboring cell areas are used as the first cell area 411 and the second cell area 412, and the ink discharge points formed outside the two neighboring cell areas and between the two neighboring cell areas are used as the first point 431 to the third point 433, and the correction unit 320 may correct a pattern recipe to be commonly applied to two neighboring cell areas, or correct a pattern recipe to be differentially applied to two neighboring cell areas according to any one of the common mode and the differential mode.

The correction unit 320 may correct the pattern recipe of the cell area formed on the substrate (S) in the X-axis direction based on information on a plurality of ink discharge points arranged in a row in the first direction 10.

However, this embodiment is not limited thereto. The correction unit 320 may correct the pattern recipe of the cell area formed on the substrate (S) in the Y-axis direction based on information on a plurality of ink discharge points arranged in a row in the second direction 20.

Further, the correction unit 320 may correct the pattern recipe of the cell area formed on the substrate (S) not only in the X-axis direction, but also in the Y-axis direction and the θ-axis (slope) direction based on information on a plurality of ink discharge points arranged in a row in the first direction 10 and information on a plurality of ink discharge points arranged in a row in the second direction 20.

It will be described again with reference to FIG. 3.

The control unit 330 functions to control the entire operation of the recognition unit 310 and the correction unit 320 constituting the ink impact point correction apparatus 300. The control unit 330 may be implemented as a computer device (or software installed in the computer device).

In this embodiment, the ink impact point correction apparatus 300 may be implemented as a computer device. In this case, the recognition unit 310 may be embedded in the computer device as software that can control the vision camera, and the correction unit 320 may be embedded in the computer device as software that can control the jetting drive, the axis movement control unit, etc.

The ink impact point correction apparatus 300 may further include a power supply unit 340 and a selection unit 350 as shown in FIG. 24. FIG. 24 is a conceptual diagram schematically showing an internal configuration of an ink impact point correction apparatus according to another embodiment of the present invention.

The power supply unit 340 performs a function of supplying power to each module constituting the ink impact point correction apparatus 300.

The selection unit 350 performs a function of selecting an ink discharge point, to which ink is discharged on the substrate (S). When the ink discharge point is selected by the selection unit 350, the gantry unit 130 may move on the base 110 so that the inkjet head module 150 is located at the selected point on the substrate (S), and the inkjet head module 150 may discharge ink at that point. Then, the recognition unit 310 and the correction unit 320 may perform the functions described above by targeting the ink discharge point selected by the selection unit 350.

The selection unit 350 may select a plurality of ink discharge points on the substrate (S). At this time, when the inkjet head module 150 reaches each ink discharge point on the substrate (S) (i.e., the first point to the nth point (where n is a natural number of 2 or more)), the inkjet head module 150 may discharge ink at the corresponding point.

The selection unit 350 may be implemented as software installed in a computer device. Alternatively, the selection unit 350 may be a computer device that executes software.

The ink impact point correction apparatus 300 according to various embodiments of the present invention has been described above with reference to FIGS. 3 to 24. The ink impact point correction apparatus 300 measures and corrects the impact point of ink in real time/automatically using a pattern on a substrate, on which a coordinate system is displayed. The ink impact point correction apparatus 300 may be applied to various pattern printing equipment including ink-jet equipment.

Although the embodiments of the present invention have been described with reference to the above and the accompanying drawings, those of ordinary skill in the art to which the present invention pertains can understand that it can be implemented in other specific forms without changing the technical spirit or essential features of the present invention. Therefore, it should be understood that the embodiments described above are illustrative and non-limiting in all respects.

What is claimed is:

1. An apparatus for correcting an impact point of ink comprising:

a recognition unit for acquiring information on an impact point of ink at a plurality of points located on a substrate; and a correction unit for correcting a position of an ink discharge point on the substrate based on the information on the impact point, wherein a coordinate pattern in a form of a coordinate system is formed at the plurality of points, wherein there are a plurality of cell areas on the substrate, wherein the correction unit corrects the position of the ink discharge point by selecting one of a first mode and a second mode based on relationship information between two neighboring cell areas of the plurality of cell areas, and wherein the correction unit uses at least one of information on whether applications having the same size are installed in the two neighboring cell areas, information on whether an application having thermal deformation is installed in the two neighboring cell areas, and information on whether an alignment is changed between the two neighboring cell areas as the relationship information.

2. The apparatus of claim 1, wherein the recognition unit recognizes coordinates of a droplet of the ink and acquires information on the impact point when the droplet of the ink is discharged on the coordinate pattern.

3. The apparatus of claim 1, wherein the correction unit, when coordinates of a plurality of ink droplets are acquired as information on the impact point, calculates a slope based on the coordinates of the plurality of ink droplets, and corrects the position of the ink discharge point based on the slope.

4. The apparatus of claim 1, wherein the correction unit, when coordinates of a plurality of ink droplets are acquired as information on the impact point, corrects the position of the ink discharge point so that all coordinate values of at least one axis in the coordinates of the plurality of ink droplets are 0.

5. The apparatus of claim 1, wherein the correction unit corrects the position of the ink discharge point using the first mode when correcting a pattern recipe to be commonly applied to the two neighboring cell areas, wherein the recognition unit, when the correction unit corrects the position of the ink discharge point using the first mode, recognizes the impact point at a plurality of points located outside the two neighboring cell areas.

6. The apparatus of claim 1, wherein the correction unit corrects the position of the ink discharge point using the second mode when correcting a pattern recipe to be differentially applied to the two neighboring cell areas, wherein the recognition unit, when the correction unit corrects the position of the ink discharge point using the second mode, recognizes the impact point at a plurality of points located outside the two neighboring cell areas and at least one point located between the two neighboring cell areas.

7. The apparatus of claim 1, wherein the plurality of points are formed in a dummy area, in which no cell area is formed on the substrate.

8. The apparatus of claim 7, wherein the plurality of points are formed in the dummy area before the cell area is formed on the substrate, or after the cell area is formed on the substrate, wherein the plurality of points are formed in the dummy area based on an alignment mark formed on the substrate when the plurality of points are formed in the dummy area before the cell area is formed on the substrate.

9. The apparatus of claim 1, wherein the recognition unit recognizes the impact point at the plurality of points arranged in a row in at least one direction on the substrate to acquire information on the impact point.

10. The apparatus of claim 9, wherein the recognition unit recognizes the impact point at two points located on outside ends of the row when recognizing the impact point at the plurality of points arranged in the row in one direction on the substrate.

11. The apparatus of claim 9, further comprising a selection unit for selecting the plurality of points to which ink is to be discharged by considering a moving direction of the substrate relative to the recognition unit.

12. The apparatus of claim 11, wherein the plurality of points arranged in a direction different from the moving direction of the substrate are selected.

13. The apparatus of claim 1, wherein the recognition unit recognizes the impact point at the plurality of points arranged in a row in at least two directions on the substrate, wherein the correction unit corrects a pattern recipe to be applied to a cell area on the substrate in at least two directions.

14. The apparatus of claim 1, wherein the correction unit corrects the position of the ink discharge point by controlling timing of discharging ink onto the substrate, or corrects the position of the ink discharge point by correcting a position or posture of a device discharging ink onto the substrate, or corrects the position of the ink discharge point by correcting a position or posture of the substrate.

15. The apparatus of claim 1, wherein the correction unit corrects the position of the ink discharge point before patterning RGB on the substrate.

16. An apparatus for correcting an impact point of ink comprising:

a recognition unit for acquiring information on an impact point of ink at a plurality of points located on a substrate; and a correction unit for correcting a position of an ink discharge point on the substrate based on the information on the impact point, wherein there are a plurality of cell areas on the substrate, wherein the correction unit corrects the position of the ink discharge point by selecting one of a first mode and a second mode based on relationship information between two neighboring cell areas of the plurality of cell areas, wherein the correction unit uses at least one of information on whether applications having the same size are installed in the two neighboring cell areas, information on whether an application having thermal deformation is installed in the two neighboring cell areas, and information on whether an alignment is changed between the two neighboring cell areas as the relationship information, wherein the correction unit corrects the position of the ink discharge point using the first mode when correcting a pattern recipe to be commonly applied to the two neighboring cell areas, wherein the correction unit corrects the position of the ink discharge point using the wherein the correction unit corrects the position of the ink discharge point using the second mode when correcting a pattern recipe to be differentially applied to the two neighboring cell areas.

17. A system for treating a substrate comprising:

a substrate support unit for supporting a substrate;

a gantry unit movably installed on the substrate;

an inkjet head module installed on the gantry unit and for discharging ink onto the substrate; and an ink impact point correction apparatus comprising a recognition unit for acquiring information on an impact point of ink at a plurality of points located on the substrate; and a correction unit for correcting a position of an ink discharge point on the substrate based on the information on the impact point, wherein a coordinate pattern in a form of a coordinate system is formed at the plurality of points, wherein there are a plurality of cell areas on the substrate, wherein the correction unit corrects the position of the ink discharge point by selecting one of a first mode and a second mode based on relationship information between two neighboring cell areas of the plurality of cell areas, and wherein the correction unit uses at least one of information on whether applications having the same size are installed in the two neighboring cell areas, information on whether an application having thermal deformation is installed in the two neighboring cell areas, and information on whether an alignment is changed between the two neighboring cell areas as the relationship information.

* * * * *